US007405179B2

(12) United States Patent
Hiyoshi et al.

(10) Patent No.: US 7,405,179 B2
(45) Date of Patent: Jul. 29, 2008

(54) THERMOSENSITIVE RECORDING MEDIUM AND METHOD OF MANUFACTURING THE SAME

(75) Inventors: Takayuki Hiyoshi, Shizuoka-ken (JP); Toshiyuki Tamura, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 1 day.

(21) Appl. No.: 10/854,413

(22) Filed: May 27, 2004

(65) Prior Publication Data

US 2005/0215431 A1 Sep. 29, 2005

(30) Foreign Application Priority Data

Mar. 15, 2004 (JP) ..... 2004-072635
Mar. 15, 2004 (JP) ..... 2004-072636

(51) Int. Cl.
*B41M 5/42* (2006.01)

(52) U.S. Cl. ..... 503/200; 427/150; 427/152; 503/207; 503/209; 503/226

(58) Field of Classification Search ..... 503/200–226
See application file for complete search history.

(56) References Cited

U.S. PATENT DOCUMENTS 4,910,184 A * 3/1990 Ishida et al. ..... 503/207
5,420,094 A * 5/1995 Araki et al. ..... 503/216
5,810,397 A 9/1998 Mehta et al.
6,578,875 B2 6/2003 Tamura et al.
2001/0049340 A1 12/2001 Tamura et al.

FOREIGN PATENT DOCUMENTS

JP 57-178791 11/1982
JP 60-208283 10/1985
JP 2000-301835 10/2000
JP 1095787 A1 2/2001
JP 2003-291982 10/2003

OTHER PUBLICATIONS

U.S. Appl. No. 09/648,545.

* cited by examiner

*Primary Examiner*—Bruce H Hess
(74) *Attorney, Agent, or Firm*—Pillsbury Winthrop Shaw Pittman, LLP

(57) ABSTRACT

A multicolor thermosensitive recording medium having thermosensitive coloring layers which are formed by printing water-dispersion thermosensitive inks or water-dispersion inks on an ink receptive layer using a printing plate. The recording medium comprises an ink receptive layer formed on a surface of a substrate, thermosensitive coloring layers developing different colors, which are integrated with the ink receptive layer by impregnating the ink receptive layer with a water-dispersion thermosensitive ink that is prepared by dispersing in water a pigment component including at least an electron-accepting compound and electron-donating compound. The color density and coloring sensitivity of the thermosensitive coloring layers have been improved by providing over the thermosensitive coloring layers an auxiliary coloring layer containing at least one of an electron-accepting compound and a sensitizer.

29 Claims, 10 Drawing Sheets

Thermosensitive coloring layer not provided
(Comparative example 1)

Thermosensitive coloring layer provided
(Comparative example 3)

A: Streaking

THERMOSENSITIVE RECORDING MEDIUM AND METHOD OF MANUFACTURING THE SAME

BACKGROUND OF THE INVENTION

CROSS REFERENCE TO RELATED APPLICATIONS

This application is based upon and claims the benefit of priority from the prior Japanese Patent Application Nos. 2004-072635 filed on Mar. 15, 2004, and 2004-072636 filed on Mar. 15, 2004, the contents of which are incorporated herein by reference.

1. Field of the Invention

The present invention relates to a thermosensitive recording medium and method of manufacturing the same. The invention particularly relates to a multicolor thermosensitive recording medium that develops plural colors and records in high quality, and to a method of manufacturing the same.

2. Description of Related Art

There have been proposed multicolor thermosensitive recording mediums that can form multicolor images in which two or more thermosensitive coloring layers each developing different color are divisionally formed on a substrate.

For example, in Japanese patent application (Kokai) publication No. 60-208283 a multicolor thermosensitive recording medium is described in which plural thermosensitive coloring materials each of which develops different color are coated on a recording surface of a substrate in a divisional manner and which can form images of different colors on the respective parts each of which has a coating of one color.

In Japanese patent application (Kokai) publication No. 2000-301835, another multicolor thermosensitive recording medium that develops divisionally different colors is described. The recording medium comprises a support, at least two dye layers comprising different leuco dyes developing different colors arranged in parallel on the support without superimposing one layer upon another, and a developer layer or layers containing a developer that are disposed adjacent to, on and/or below the dye layers. The multiple coloring layers having different colors are formed into stripes by reiterating a printing process (screen printing, gravure printing, offset printing). By reducing the bandwidth of the dye layer band and miniaturizing the size of a heat-applying part of the recording head, a high-resolution image in full-color can be formed.

However, the inventors of the present invention perceived some problems, which will be described below, when forming plural thermosensitive coloring layers each developing different color, as described in the above patent applications, on a substrate by means of a printing process, and have come to conceive a new structure of a multicolor thermosensitive recording medium and the manufacturing method thereof.

A multicolor thermosensitive recording medium is conventionally manufactured by coating thermosensitive ink all over its substrate. The thermosensitive ink widely uses a water-dispersion thermosensitive ink, which is formulated by dispersing in water, using a dispersant such as a surfactant, pigments including an electron-accepting compound such as a developer, an electron-donating compound such as a leuco dye, and a sensitizer. This water-dispersion thermosensitive ink is coated over a substrate using a coater. The coater includes a blade coater, air knife coater, roll coater, bar coater, gravure coater, and lip coater.

The inventors discovered that, when a thermosensitive coloring layer is formed by printing a water-dispersion thermosensitive ink over a relatively wide area in part of a substrate using a printing plate such as planographic plate, relief printing plate, engraved plate, and stencil printing plate in stead of using the coating method mentioned above, a striped pattern A, as shown FIG. 12, emerges on a surface of the thermosensitive coloring layer. In order to attain fair developing color density on a thermosensitive recording medium, the thickness of the coating of the water-dispersion thermosensitive ink needs to be increased by a large margin comparing to that of an ink film formed when printing on a plain paper using an offset ink. However, in the case that the thermosensitive recording medium thickly coated with the water-dispersion thermosensitive ink on its substrate is dried by being heated in an oven, the striped pattern A appeared remarkably on the medium. This striped pattern A appearing in a state of unevenness is considered to have been developed because the water-dispersion thermosensitive ink remained unevenly appearing as a stripe on a substrate, failing to spread smoothly over the substrate after the printing plate was separated from the substrate during the printing process. This phenomenon is called "streaking" as it looks like a pattern formed after streaming of a liquid. This phenomenon of "streaking" is considered to be developed because some particles of pigments in the water-dispersion thermosensitive ink flocculate, causing a variation in thickness of the ink coating that looks as "stripes."

When an image is produced on a thermosensitive recording medium holding such striped pattern A in its thermosensitive coloring layer by applying heat energy onto the medium, color density produced in the area of striped pattern A on the medium becomes uneven. This uneven development of color density occurs because a surface of a thermal printhead contacts only the thick parts on the thermosensitive coloring layer but not the thin parts.

If an organic-solvent based thermosensitive ink, which was formulated using an organic solvent in which a leuco dye and developer were dispersed, was used in place of the water-dispersion thermosensitive ink, striped pattern A hardly emerged. The reason is assumed that the organic-solvent based thermosensitive ink that was printed typically holds an excellent liquid-leveling characteristic comparing to the water-dispersion thermosensitive ink. However, the organic-solvent based thermosensitive ink has some difficulties. That is, an organic solvent readily dissolves substances like a developer and leuco dye used as constituents in the thermosensitive ink, and fogging tends to occur on a medium surface. To reduce a degree of this fogging, the kind of a leuco dye and developer needs to be restricted and therefore a selectable range of kind of materials that develop various colors is narrowed. In addition, the organic-solvent based thermosensitive ink has problems that colorization with the ink is difficult and it requires a high manufacturing cost. In view of these problems, use of a water-dispersion thermosensitive ink is considered preferable.

SUMMARY OF THE INVENTION

The object of the present invention is to provide a thermosensitive coloring layer that realizes a uniform and practically sufficient color density when a thermosensitive recording medium having a thermosensitive coloring layer is produced such that a water-dispersion thermosensitive ink or water-dispersion ink is printed by means of a printing process using a printing plate. Another object of the present invention is to provide a multicolor thermosensitive recording medium having multiple thermosensitive coloring layers each of which develops different color.

According to one aspect of the present invention, there is provided a thermosensitive recording medium having a thermosensitive coloring layer that is formed integrally with an ink receptive layer by impregnating the ink receptive layer provided on a substrate with a water-dispersion thermosensitive ink.

According to another aspect of the present invention, there is provided a thermosensitive recording medium having a thermosensitive coloring layer that is formed integrally with an ink receptive layer containing an electron-accepting compound provided on a surface of a substrate by impregnating the ink receptive layer on a substrate with a water-dispersion ink that is formulated by dispersing in water a pigment component containing at least an electron-donating compound.

According to further aspect of the present invention, there is provided a thermosensitive recording medium in which a thermosensitive coloring layer and an auxiliary coloring layer are laminated. This thermosensitive recording medium comprises: a thermosensitive coloring layer which is formed integrally with an ink receptive layer provided on a surface of a substrate which is impregnated with water-dispersion thermosensitive ink that is formulated by dispersing in water a pigment component containing at least an electron-accepting compound and an electron-donating compound; and an auxiliary coloring layer containing at least one of an electron-accepting compound and a sensitizer.

DETAILED DESCRIPTION OF A PREFERRED EMBODIMENT OF THE INVENTION

First Embodiment

The first embodiment of the present invention will be described in reference to FIGS. 1, 2, and 3.

Figure 1:
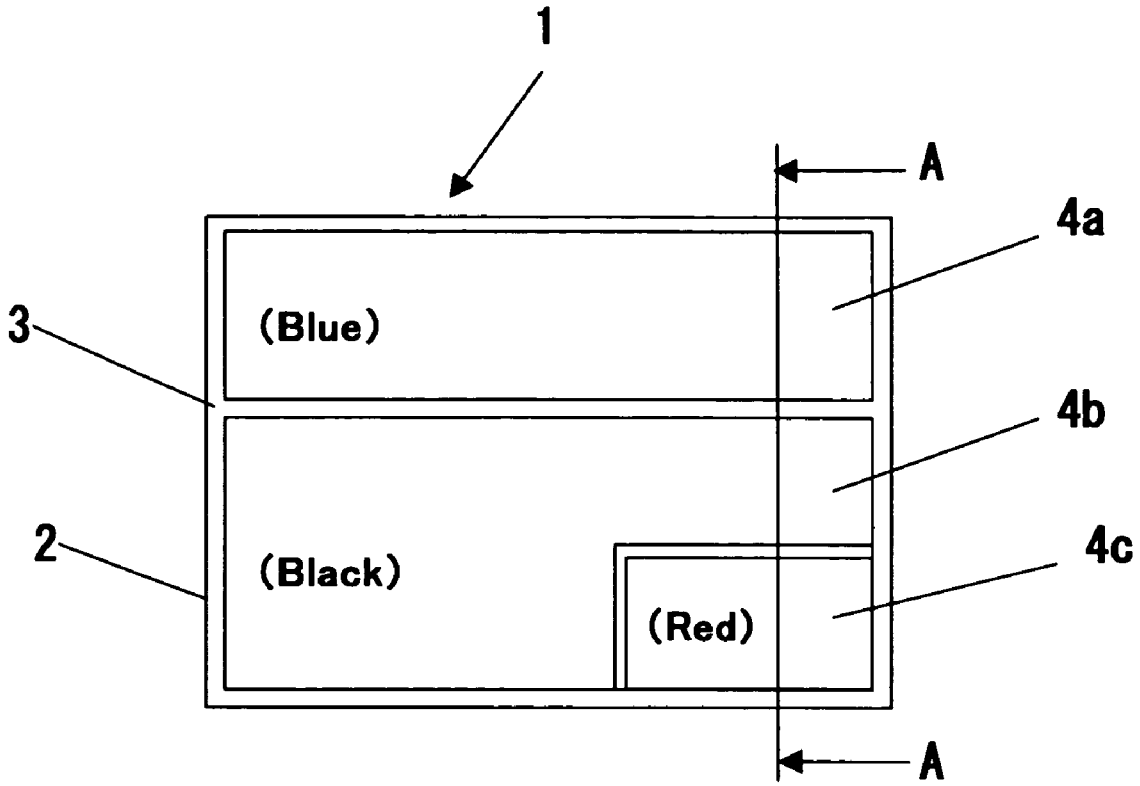
FIG. 1 is a plan view of the thermosensitive recording medium in the first embodiment of the present invention.
Figure 2:
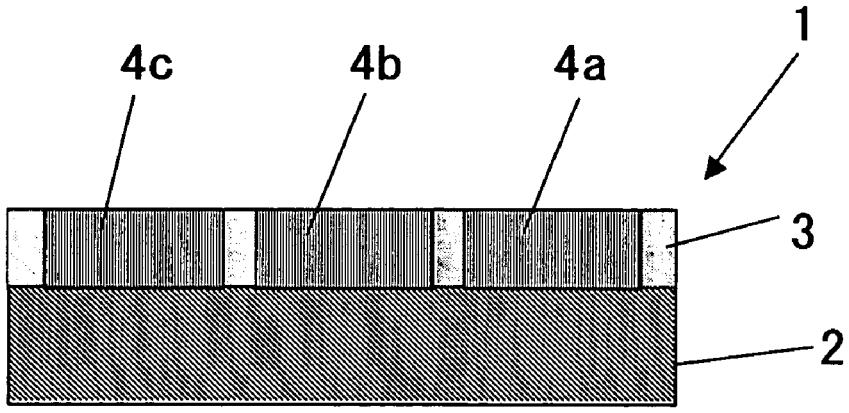
FIG. 2 is a cross-sectional view of the thermosensitive recording medium of the first embodiment taken along line A-A of FIG. 1.

A thermosensitive recording medium 1 shown in FIG. 1 comprises a substrate 2, an ink receptive layer 3 formed on substrate 2, and thermosensitive coloring layers 4*a*, 4*b*, and 4*c*, each of which has different developing color and is formed in ink receptive layer 3. As needed, a protective layer may be provided over ink receptive layer 3 and thermosensitive coloring layers 4*a*, 4*b*, and 4*c*. By applying heat energy to the thermosensitive coloring layer of each color on thermosensitive recording medium 1 by a thermal printhead as shown in FIG. 3, recording in different colors can be achieved. For example, a catchphrase "Articles on bargain sale" in blue on thermosensitive coloring layer 4*a*, "a bar code" in black on thermosensitive coloring layer 4*b*, and "price of an article" in red on thermosensitive coloring layer 4*c* can be recorded.

Substrate 2 is made of, for example, paper, plastic film of polyethylene terephthalate or the like, or metal-leaf. Materials to be used for substrate 2 are not restricted to the above-mentioned, as long as they do not prevent the object of the invention from being achieved.

Ink receptive layer 3 comprises a pigment as its main component and a binder resin. Pigments usable for this layer include, for example, an inorganic pigment, such as clay, calcined clay, calcium carbonate, titanium oxide, alumina, aluminum hydroxide, silica; an organic pigment of a beaded resin or hollow resin comprising of resins such as styrenes, styrene-acrylics, acrylics. Also preferable for use is a porous pigment, for example, a calcium carbonate or synthetic silica, which is formed by a mass of its primary particles. More effective materials are hydrophilic pigments such as silica, alumina, titanium, etc., which have been processed for surface treatment so that their pigment surfaces bear a hydroxyl group (—OH) of a hydrophilic group. Among these hydrophilic pigments, a porous pigment, for example, a hydrophilic silica that is formed by a flocculated mass of its primary particles, is even more preferable.

Binder resins usable for ink receptive layer 3 include water-soluble macromolecules and water-soluble macromolecule emulsions. The water-soluble macromolecules are, for example, polyvinyl alcohol, starch and its derivatives, cellulosic derivatives, gelatine, casein, styrene-dihydrogen maleic copolymer salt, styrene-acrylic acid copolymer salt. The water-soluble macromolecule emulsions include emulsions of latex of styrene-butadiene copolymer, vinyl acetate resin, styrene-acrylic ester copolymer, and polyurethane resin, etc.

As needed, a lubricant such as zinc stearate, wax, and/or an additive such as hindered phenols may be added to ink receptive layer 3.

Ink receptive layer 3 is formed by a process described below. First, a coating liquid is prepared by dispersing in water and mixing a hydrophilic pigment and a binder resin. If necessary, an additive as described above is added to the liquid during the formation process of the coating liquid. In addition, additives of a pigment dispersant such as sodium polyacrylate, sodium hexamethacrylate, denatured sulfonic polyvinyl alcohol, etc., a defoamer, ultraviolet absorbent, and antiseptic, etc. may be added to the liquid, as well. Next, the coating liquid prepared in the above is coated by a coater over a substrate in such a quantity that a weight of the coating after dried would fall in a range of 1 to 50 g/m$^2$, preferably in a range of 3 to 30 g/m$^2$, and then the coating is dried to complete forming ink receptive layer 3. For a coater in this process, a coating apparatus such as air knife coater, bar coater, roll coater, blade coater, gravure coater, etc. may be used. If needed, levelling may also be performed using a calender.

Thermosensitive coloring layers 4*a*, 4*b*, and 4*c* each developing different color, which include at least an electron-accepting compound, electron-donating compound, and binder resin are formed integrally with ink receptive layer 3.

The electron-donating compound can use a leuco dye. To be more specific, usable as a black dye are PSD-150, PSD-184, PSD-300, PSD-802, PSD-290 of Nippon Soda Co., Ltd.; CP-101, BLACK-15, OBD, OBD2 of Yamamoto Chemicals Inc.; BLACK-100, S-205, BLACK-305, BLACK-500 of Yamamoto Chemicals Inc.; and TH-107 of Hodogaya Chemical Co., Ltd. Usable as a blue dye are CVL, BLUE-63, BLUE-502 of Yamamoto Chemicals Inc.; BLUE-220 of Yamada Kagaku Co., Ltd.; and BLUE-3 of Hodogaya Chemical Co., Ltd. Usable as a red dye are PSD-HR, PSD-P, PSD-O of Nippon Soda Co., Ltd.; Red-3, Red-40 of Yamamoto Chemicals Inc.; Red-500, Red-520 of Yamada Kagaku Co., Ltd.; and Vermilion-DCF, Red-DCF of Hodogaya Chemical Co., Ltd. Among the dyes indicated in the above, more than one kind may be mixed. Dyes other than black, blue, or red may also be used.

The electron-accepting compound is used as a developer. To be more specific, oxides such as phenols, phenolic metallic salts, carboxylic metallic salts, sulfonic acid, sulphonate, phosphoric acid, phosphoric metallic salts, acid ester phosphate, phosphorous acids, phosphorous acid metallic salts may be used. These materials may be used either alone or mixed as well.

The usable binder resins are water-soluble resins such as starches, celluloses, polyvinyl alcohols, and resin latexes such as polyvinyl acetate, polyurethane, polyacrylic ester. These materials may be used either alone or mixed as well.

Thermosensitive coloring layers 4*a*, 4*b*, and 4*c* are formed by coating a water-dispersion thermosensitive ink on the ink receptive layer by means of a printing process. In descriptions hereafter, to coat a water-dispersion thermosensitive ink or water-dispersion ink using a printing plate will be referred to as "to print," and to develop a color by applying heat energy to the medium using a thermal printhead as "to record image/characters."

The water-dispersion thermosensitive ink is formulated by dispersing and mixing in water a leuco dye, developer, and binder resin, and if necessary, adding pigments of sensitizer, printhead abrasion resistance agent, and anti-sticking agent to the liquid. In this dispersion/mixing process, if need be, a modified resin such as denatured sulfonic polyvinyl alcohol, a dispersant such as surfactant, various additives such as defoamer, ultraviolet absorbent, antiseptic, etc. may be added to the ink. Mixing a sensitizer to the ink can effect to lower the development temperature of thermosensitive coloring layers 4*a*, 4*b*, and 4*c*, and thus to reduce heat energy for color development. For the printhead abrasion resistance agent and anti-sticking agent, wax, zinc stearate, amide stearate, or calcium carbonate may be used.

When thermosensitive coloring layers, 4*a*, 4*b*, and 4*c* are formed with water-dispersion thermosensitive ink by means of a printing process using a printing plate, particularly in the case of using an engraved plate or stencil printing plate, the water-dispersion thermosensitive ink needs to be put into the graves or dents. In this case, to make the water-dispersion thermosensitive ink fit in the printing plate, a surfactant needs to be added to the ink. An anionic surfactant such as ELECTROSTRIPPER F (polyoxyethylane alkylether potassium phosphate, manufactured by KAO Corporation), LATEMUL PS (alkane sodium sulfonate, manufactured by KAO Corporation), ADEKACOL EC-4500 (dioctyl ester salt sulfosuccinate, manufactured by Asahi Denka Co., Ltd.) S-11N (perfluoro alkyl-containing oligomer, manufactured by Dainippon Ink & Chemicals Co., Ltd.), or a nonionic surfactant such as EXP4001, EXP4036, DYNOL 604, SURFYNOL 420, SURFYNOL 440, SURFYNOL 485 (acetylene-glycol-based compound, manufactured by Air Products, Inc.), F-479 (perfluoro-alkyl-containing olygomer, manufactured by Dainippon Ink & Chemicals Co., Ltd.), S-141 (perfluoro alkyl compound, manufactured by Seimi Chemical Co., Ltd.), is to be added to the ink, either alone or mixed. In this case, since an anionic surfactant contains an ion of Na or $NH_4$ that corrodes a thermal printhead, use of a nonionic surfactant is desirable.

The water-dispersion thermosensitive ink is printed partially on ink receptive layer 3 by means of flexographic printing or gravure printing process using a planographic plate, relief printing plate, engraved plate, or stencil printing plate to such an amount of the water-dispersion thermosensitive ink whose weight after dried would be in a range of 1 to 50 g/m$^2$, preferably in a range of 3 to 10 g/m$^2$. As shown in FIG. 1, ink receptive layer 3 is formed on a substrate in a region wider than the thermosensitive coloring layers 4*a*, 4*b*, and 4*c*, and the respective thermosensitive coloring layer are formed by selectively printing one of the water-dispersion thermosensitive inks corresponding to a desired region in the thermosensitive coloring 4*a*, 4*b*, and 4*c*. FIG. 2 is a sectional view of the thermosensitive recording medium after the printing was performed in the water-dispersion thermosensitive ink. The thermosensitive coloring layer is partially formed such that the water-dispersion thermosensitive ink corresponding to each color that has been printed on ink receptive layer 3 by means of gravure printing is penetrated into the ink receptive layer from the surface thereof so that the layer and the ink become integrated into one. This integration by impregnating the layer with the ink can effect to reduce occurrence of a phenomenon of "streaking." After formation of the thermosensitive coloring layers, if necessary, levelling processing may be performed using a calender or the like. Also, if necessary, a protective layer may be provided.

So far, description for the first embodiment has been made in conjunction with a structure of the medium in which thickness of ink receptive layer 3 coincides with those of thermosensitive coloring layers 4*a*, 4*b*, and 4*c*. For a variation of the structure in this embodiment, if necessary developing color density can be obtained with the coloring layers, each thickness of thermosensitive coloring layers 4*a*, 4*b*, and 4*c* may be reduced being thinner than that of ink receptive layer 3, as indicated in FIG. 2. Also, an auxiliary coloring layer 5, which will be described later, may be provided over the thermosensitive coloring layers.

Figure 5:
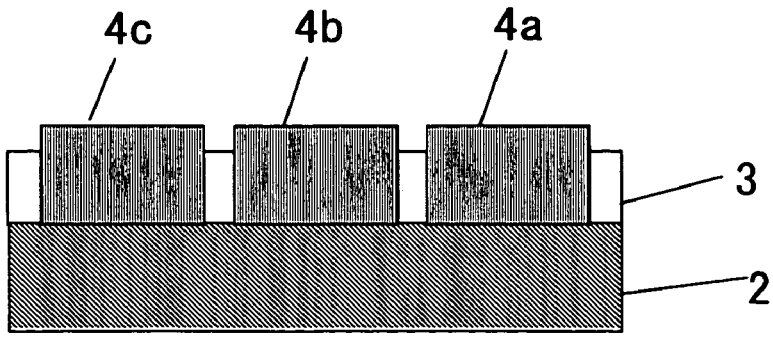
FIG. 5 is a cross-sectional view of another variation of the thermosensitive recording medium in the first embodiment.
Figure 16:
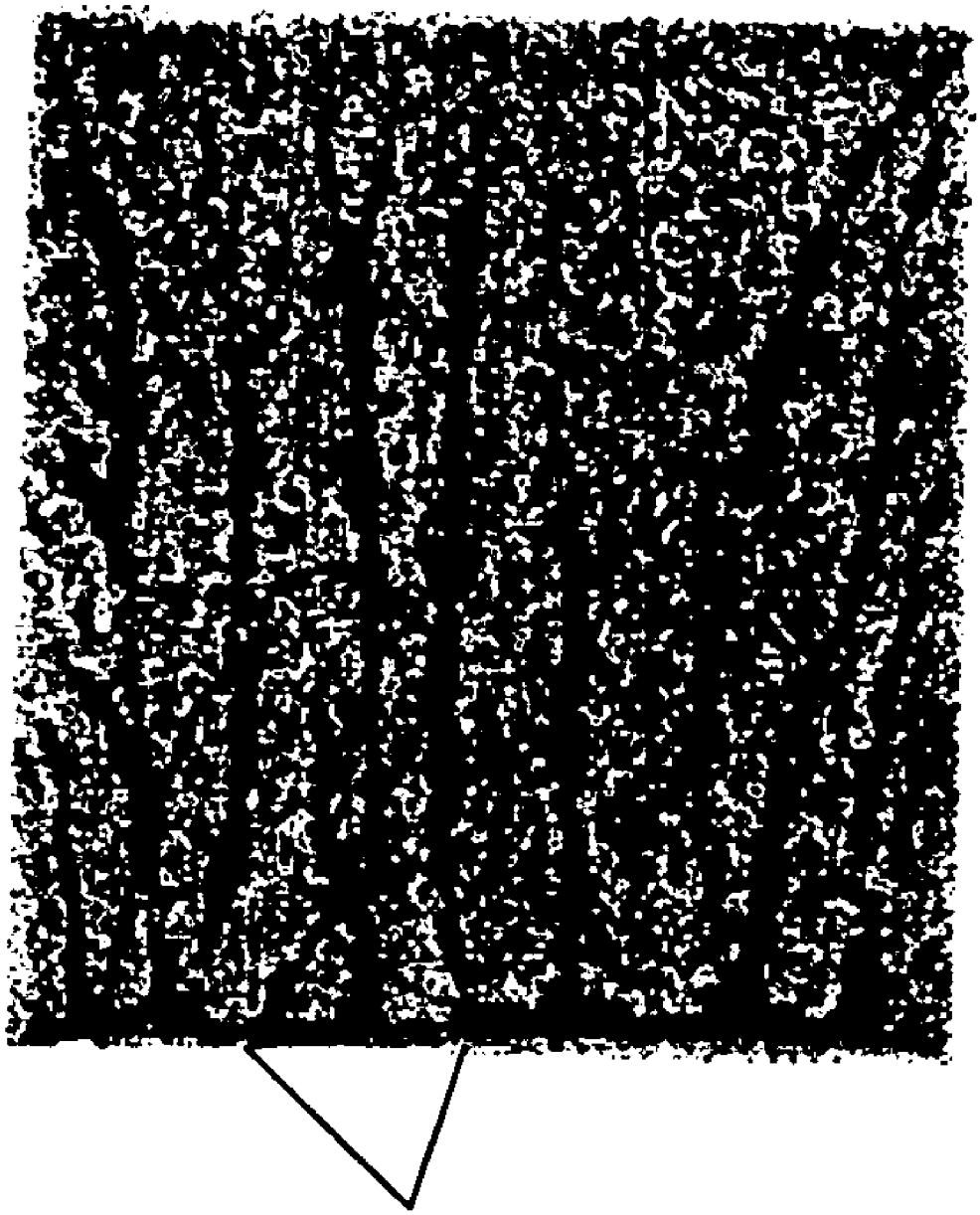
FIG. 16 is a photograph showing a state of developing a striped pattern when a water-dispersion thermosensitive ink was printed on a substrate by gravure printing method.

If sufficient developing color density cannot be obtained, the thickness of the thermosensitive coloring layers can be increased to be thicker than that of ink receptive layer 3, as shown in FIG. 5. However, in such a case that each of thermosensitive coloring layers is thicker than ink receptive layer 3, as in indicated in FIG. 5, it should be borne in mind that, as the thickness of a water-dispersion thermosensitive ink layer increases, striped pattern A, as indicated in FIG. 16, tends to emerge. For this reason, it is preferable that ink receptive layer 3 is impregnated with the water-dispersion thermosensitive ink to such a degree that the ink does not flow out of the ink receptive layer 3.

The above description has been made for a process of forming the thermosensitive coloring layers using a water-dispersion thermosensitive ink. The thermosensitive coloring layers may also be formed using a water-dispersion ink in place of the water-dispersion thermosensitive ink. The water-dispersion thermosensitive ink is composed mainly of a leuco dye, developer, and binder resin, while a water-dispersion ink consists chiefly of a leuco dye and binder resin. A thermosensitive coloring layer using water-dispersion ink is formed by printing the water-dispersion ink on an ink receptive layer containing a developer so that the water-dispersion ink and the ink receptive layer has become integrated into one.

Hereinafter, specific compositions of thermosensitive recording medium 1 using the water-dispersion thermosensitive ink and water-dispersion ink will be described by using examples. In the following examples, unit "part(s)" means "part(s) by weight."

EXAMPLE 1

Formation of Ink Receptive Layer

1a) Pigment Dispersion Liquid

A pigment dispersion liquid of hydrophilic silica having an average particle size of 1.5 μm was prepared by dispersing the following compositions using a homogenizer.

| | |
|---|---|
| Hydrophilic silica<br>Nipsil E-743 (brand name), manufactured by Tosoh Silica Corp. | 100 parts |
| Sodium polyacrylate (dispersant) | 1 part |
| Water | 340 parts |

1b) Coating Liquid

To prepare this coating liquid for ink receptive layer 3, the following componnets were added to, dispersed, and mixed in the pigment dispersion liquid prepared in the above process 1a) using a homogenizer.

| | |
|---|---|
| Styrene-butadiene copolymer latex (binder resin)<br>48%-SBR dispersion liquid, manufactured by JSR | 30 parts |
| Phosphate ester starch (binder resin)<br>MS-4600 (20% aqueous solution), manufactured by Nihon Shokuhin Kako Co., Ltd. | 20 parts |

1c) Ink Receptive Layer

An ink receptive layer 3 was formed on a substrate 2 (quality paper) having a weight of 65 g/m$^2$ by coating with a bar coater the coating liquid prepared in the above process 1b) over the substrate 2 in an amount corresponding to a weight of 8 g/m$^2$ of the coating after dried.

Formation of Thermosensitive Coloring Layer

1d) Water-Dispersion Thermosensitive Ink

Water-dispersion thermosensitive inks of three kinds whose developing colors are blue, black and red were prepared by mixing developer dispersion liquid, sensitizer dispersion liquid, lubricant dispersion liquid, recrystalization-inhibitor dispersion liquid, calcium-carbonate dispersion liquid, 10%-PVA dispersion liquid, surfactant, and water with leuco-dye dispersion liquids of each color of blue, black, and red, as displayed below.

| | |
|---|---|
| Leuco dye dispersion liquid (30% of solid composition)<br>A leuco dye dispersion liquid was prepared by adding to water a dispersant of GOHSERAN L-3266 (manufactured by The Nippon Synthetic Chemical Industry Co., Ltd.) to obtain 5% concentration, further adding to the liquid and dispersing each of the following leuco dyes by a sand mill so as to obtain an average particle size of 0.8 μm.<br>Using each of the leuco dyes of different colors, three dispersion leuco dye liquids of blue, black, and red were prepared.<br>Blue (CVL, manufactured by Yamamoto Chemicals Inc.)<br>Black (OBD-2, manufactured by Yamamoto Chemicals Inc.)<br>Red (Vermilton-DCF, manufactured by Hodogaya Chemical Co., Ltd.) | 50 parts |
| Developer dispersion liquid (40% of solid composition)<br>D-8 (developer), manufactured by Nippon Soda Co., Ltd.<br>F-647 (dispersion liquid using D-8), manufactured by Chukyo Yushi Co., Ltd. | 75 parts |
| Sensitizer dispersion liquid (30% of solid composition)<br>To prepare this liquid, GOHSERAN L-3266 (manufactured by The Nippon Synthetic Chemical Industry Co., Ltd.) as a dispersant was added to water so as to obtain 5% concentration, and a sensitizer, indicated below, was added to it, and then the liquid was grinded using a sand mill so as to get an average particle size of 0.8 μm.<br>HS-3520, manufactured by Dainippon Ink & Chemicals Co., Ltd. | 100 parts |
| Lubricant dispersion liquid (30% of solid composition)<br>Zinc stearate: HIDRIN Z-7-30 (brand name), manufactured by Chukyo Yushi Co., Ltd. | 32 parts |
| Recrystalization-inhibitor dispersion liquid (35% of solid composition)<br>DH43 (recrystalization-inhibitor), manufactured by Asahi Denka Co., Ltd.<br>HYDRIN F-165 (recrystalization-inhibitor dispersion liquid), manufactured by Chukyo Yushi Co., Ltd. | 20 parts |
| Calcium carbonate dispersion liquid (30% of solid component)<br>To prepare this dispersion liquid, GOHSERAN L-3266 (manufactured by The Nippon Synthetic Chemical Industry Co., Ltd.) as a dispersant was added to water so as to obtain 5% concentration, and a calcium carbonate, indicated below, was added to it, and then the liquid was grinded using a sand mill so as to get an average particle size of 0.8 μm.<br>KARURAITO-KT, manufactured by Shiraishi Central Laboratories | 50 parts |
| 10%-PVA solution<br>PVA110, manufactured by Kralle Co., Ltd. | 53 parts |
| Surfactant (10% of solid composition)<br>ADEKACOL EC4500, manufactured by Asahi Denka Co., Ltd. | 33 parts |
| Water | 25 parts |

1e) Formation of Thermosensitive Coloring Layers

First, each of the water-dispersion thermosensitive inks prepared in the above process 1d) was adjusted so that the viscosity falls in a range between 30 and 40 cps (measured with an E type viscometer of Tokyo Keiki Co., Ltd.) and the surface tension becomes 30 m N/m or lower (measured with a K12-Mk5 surface tension balance, manufactured by Kruss GmbH). Lowering the surface tension of the water-dispersion thermosensitive ink using a surfactant is effective, particularly when printing using an engraved plate, since the water-dispersion thermosensitive ink having a high surface tension makes it difficult to let the ink intrude into engraved parts of the engraved plate.

Figure 17:
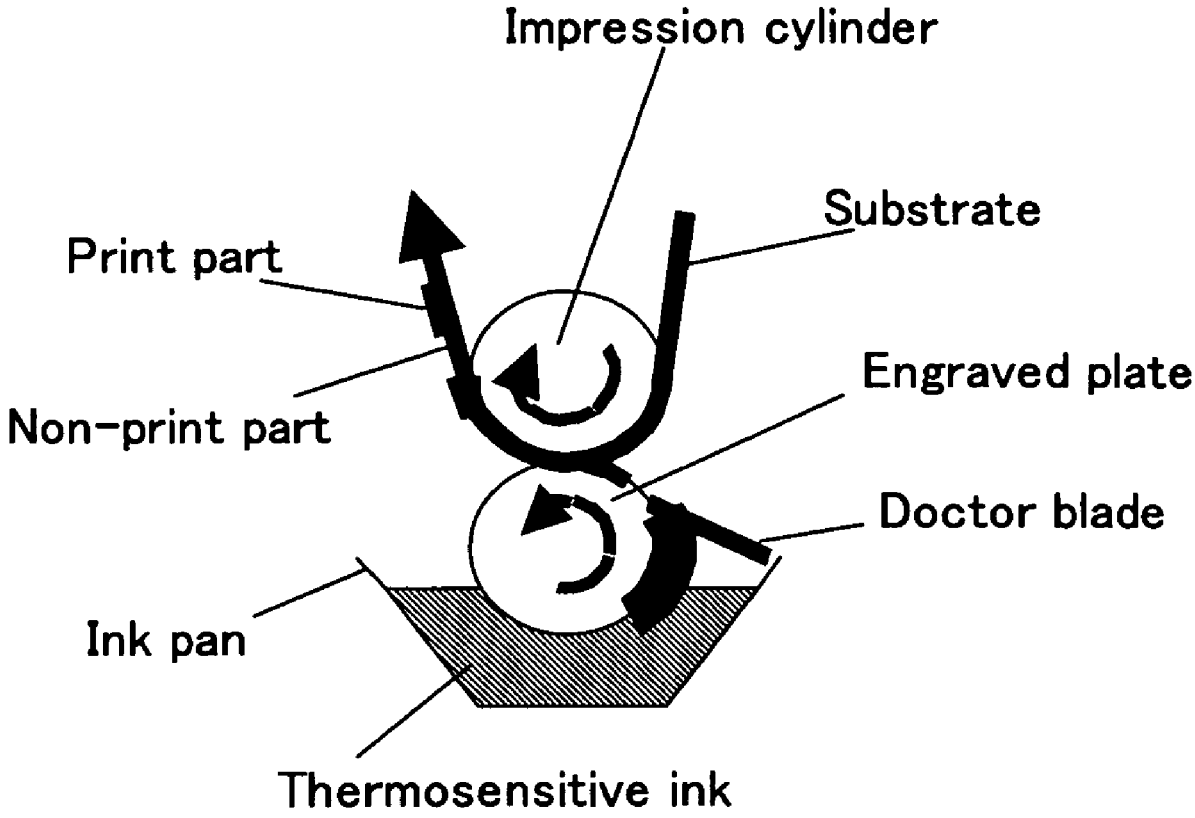
FIG. 17 is an illustration of operational principle of the simplified photogravure printing machine.

Each of the water-dispersion thermosensitive inks prepared in 1d) in the above was printed on ink receptive layer 3 using a simplified photogravure printing machine (K Printing Proofer, available from Matsuo Sangyo Co., Ltd.), equipped with an etched plate having 150 lines in cell density and 40 μm in cell depth, so that thermosensitive recording medium 1 as illustrated in FIG. 1 was produced. FIG. 17 is an illustration of operational principle of the simplified photogravure printing machine, illustrating how to form a thermosensitive coloring layer on a substrate using an engraved printing plate. In this thermosensitive recording medium 1, thermosensitive coloring layer 4*a* develops blue, 4*b* develops black, and 4*c* develops red.

To observe condition of the printing, the formed thermosensitive recording medium 1 was held at 130 degree C. in an oven for five minutes so that thermosensitive coloring layers 4*a*, 4*b*, and 4*c* developed respective colors. Before the medium was heated, "Streaking" was somewhat seen on the respective thermosensitive coloring layers formed by means of printing. After the color-development by the heat, however, the striped pattern A by "Streaking" as shown in FIG. 16 disappeared, and the thermosensitive coloring layers developed colors nearly uniformly. This has convinced us that forming a nearly uniform printed surface by means of a printing process on a thermosensitive coloring layer is possible. The reason that a nearly uniform printing surface was obtained is considered being that, because ink receptive layer 3 is absorptive, the water-dispersion thermosensitive ink is absorbed in the absorptive ink receptive layer 3 before it is dried, and that the ink receptive layer 3 and thermosensitive coloring layers 4*a*, 4*b*, and 4*c* are formed integrally.

A protective layer was formed over thermosensitive recording medium 1 shown in FIG. 1 by coating OCA-5, manufactured by Nippon Kayaku Co., Ltd., in thickness of 1 g/m$^2$ using a bar coater, and then image-recording was performed on the medium by a barcode printer KP-50 of Toshiba Tec K. K., as shown in FIG. 3. As a result, recording without irregularity in developed color density on the printed part was achieved.

EXAMPLE 2

Ink receptive layer 3 was formed in the exactly same fashion as in example 1 except for use of calcined clay (KAOCAL, available from Shiraishi Kogyo Kaisha Ltd.) having an average particle size of 0.9 μm in place of the hydrophilic silica used as a pigment in ink receptive layer 3 in example 1. Each of the water-dispersion thermosensitive inks that are prepared in example 1 was printed on this ink receptive layer 3 using a simplified photogravure printing machine (K Printing Proofer, available, from Matsuo Sangyo Co., Ltd.), equipped with an etched plate having 175 lines in cell density and 34 μm in cell depth, so that thermosensitive recording medium 1 as illustrated in FIG. 1 was produced.

When, using thermosensitive recording medium 1 that was produced in the example 2, colors were developed on thermosensitive coloring layers 4*a*, 4*b*, and 4*c* as in example 1, no striped pattern A has emerged, and a nearly uniform print surface was obtained.

Next, a protective layer was formed over thermosensitive coloring layers 4*a*, 4*b*, and 4*c* of the thermosensitive recording medium 1 by coating OCA-5, manufactured by Nippon Kayaku Co., Ltd., in 1 g/m$^2$ thick using a bar coater, and then image-recording was performed on the medium by a barcode printer KP-50 of Toshiba Tec K. K., as shown in FIG. 3. As a result, recording without irregularity in developed color density was achieved.

EXAMPLE 3

Ink receptive layer 3 was formed in the exactly same fashion as in example 1 except for use of porous calcium carbonate (KARURAITO-KT, manufactured by Shiraishi Central Laboratories) having an average particle size of 2.6 μm for the pigment in place of hydrophilic silica used as a pigment in ink receptive layer 3 in example 1. Each of the water-dispersion thermosensitive inks that are prepared in example 1 was printed on this ink receptive layer 3 using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When, using thermosensitive recording medium 1 produced in this example 3, colors were developed on thermosensitive coloring layers 4*a*, 4*b*, and 4*c* as in example 1, no striped pattern A has emerged, and a nearly uniform print surface was obtained.

Next, a protective layer was formed over thermosensitive coloring layers 4*a*, 4*b*, and 4*c* of the thermosensitive recording medium 1 by coating OCA-5, manufactured by Nippon Kayaku Co., Ltd., in thickness of 1 g/m$^2$ using a bar coater, and then image-recording was performed on the medium by a barcode printer KP-50 of Toshiba Tec K. K., as shown in FIG. 3. As a result, recording without irregularity in developed color density was achieved.

EXAMPLE 4

In this example, a thermosensitive recording medium was produced using a water-dispersion ink. Process of forming the medium is described below.

4a) Pigment Dispersion Liquid

A pigment dispersion liquid of hydrophilic silica having an average particle size of 1.5 μm was prepared by dispersing the following compositions using a homogenizer.

| | |
|---|---|
| Hydrophilic silica<br>Nipsil E-743 (brand name), manufactured by Tosoh Silica Corp. | 100 parts |
| Sodium polyacrylate (dispersant) | 1 part |
| Water | 340 parts |

4b) Coating Liquid

To prepare this coating liquid for ink receptive layer 3, the following components were added to, dispersed, and mixed in the pigment dispersion liquid prepared in the above process 4a) using a homogenizer.

| | |
|---|---|
| Styrene-butadiene copolymer latex (binder resin)<br>48%-SBR dispersion liquid, manufactured by JSR | 30 parts |
| Phosphate ester starch (binder resin)<br>MS-4600 (20% aqueous solution), manufactured by Nihon Shokuhin Kako Co., Ltd. | 20 parts |

-continued

| | |
|---|---|
| Developer dispersion liquid (40% of solid composition)<br>D-8 (developer), manufactured by Nippon Soda Co., Ltd.<br>F-647 (dispersion liquid using D-8), manufactured by Chukyo Yushi Co., Ltd. | 75 parts |

4c) Ink Receptive Layer

An ink receptive layer 3 was formed on substrate 2 (quality paper) having a weight of 65 g/m$^2$ by coating on the substrate with a bar coater the coating liquid prepared in the above process 4b) to such an amount that the coating after dried weighs 8 g/m$^2$.

Formation of Thermosensitive Coloring Layer

4d) Water-Dispersion Ink

Water-dispersion inks of three kinds whose developing colors are blue, black and red were prepared by mixing sensitizer dispersion liquid, lubricant dispersion liquid, recrystalization-inhibitor dispersion liquid, calcium-carbonate dispersion liquid, 10%-PVA dispersion liquid, surfactant, and water with leuco-dye dispersion liquid of each color of blue, black, and red, as displayed below.

| | |
|---|---|
| Leuco dye dispersion liquid (30% of solid composition)<br>A leuco dye dispersion liquid was prepared by adding to water a dispersant of GOHSERAN L-3266 (manufactured by The Nippon Synthetic Chemical Industry Co., Ltd.) so as to obtain 5% concentration and dispersing each of the following leuco dyes using a sand mill so as to obtain an average particle size of 0.8 μm.<br>Blue (CVL, manufactured by Yamamoto Chemicals Inc.)<br>Black (OBD-2, manufactured by Yamamoto Chemicals Inc.)<br>Red (Vermilton-DCF, manufactured by Hodogaya Chemical Co., Ltd.) | 50 parts |
| Sensitizer dispersion liquid (30% of solid composition)<br>To prepare this sensitizer dispersion liquid, GOHSERAN L-3266 (manufactured by The Nippon Synthetic Chemical Industry Co., Ltd.) as a dispersant was added to water so as to obtain 5% concentration, and a sensitizer, indicated below, was added to it, and then the liquid was grinded using a sand mill so as to get an average particle size of 0.8 μm.<br>HS-3520, manufactured by Dainippon Ink & Chemicals Co., Ltd. | 100 parts |
| Lubricant dispersion liquid (30% of solid composition)<br>Zinc stearate: HIDRIN Z-7-30 (brand name), manufactured by Chukyo Yushi Co., Ltd. | 32 parts |
| Recrystalization-inhibitor pigment dispersion liquid (35% of solid composition)<br>DH43 (recrystalization-inhibitor), manufactured by Asahi Denka Co., Ltd.<br>HYDRIN F-165 (recrystalization-inhibitor dispersion liquid), manufactured by Chukyo Yushi Co., Ltd. | 20 parts |
| Calcium carbonate dispersion liquid (30% of solid component)<br>To prepare this dispersion liquid, GOHSERAN L-3266 (manufactured by The Nippon Synthetic Chemical Industry Co., Ltd.) as a dispersant was added to water so as to obtain 5% concentration, and a calcium carbonate, indicated below, was added to it, and then the liquid was grinded using a sand mill so as to get an average particle size of 0.8 μm.<br>KARURAITO- KT, manufactured by Shiraishi Central Laboratories | 50 parts |
| 10%-PVA solution<br>PVA110, manufactured by Kralle Co., Ltd. | 53 parts |

-continued

| | |
|---|---|
| Surfactant (10% of solid composition)<br>ADEKACOL EC4500, manufactured by Asahi Denka Co., Ltd. | 33 parts |
| Water | 25 parts |

4e) Formation of Thermosensitive Coloring Layers

Each of the water-dispersion thermosensitive inks prepared in 4d) in the above was printed on ink receptive layer 3 formed in 4c) using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When, using thermosensitive recording medium 1 that was produced in this example 4, colors were developed on thermosensitive coloring layers 4*a*, 4*b*, and 4*c* as in example 1, no striped pattern A has emerged, and a nearly uniform print surface was obtained.

Next, a protective layer was formed over thermosensitive coloring layers 4*a*, 4*b*, and 4*c* of the thermosensitive recording medium 1 by coating OCA-5, manufactured by Nippon. Kayaku Co., Ltd., in 1 g/m$^2$ thick using a bar coater, and then image-recording was performed on the medium by a barcode printer KP-50 of Toshiba Tec K. K., as shown in FIG. 3. As a result, recording without irregularity in developed color density was achieved.

As in this example 4, thermosensitive coloring layers 4*a*, 4*b*, and 4*c* can also be formed by first coating over a whole surface of substrate 2 a coating liquid in which a developer which is one component of a thermosensitive ink is added to the pigment dispersion liquid for forming ink receptive layer 3, and by printing a water-dispersion ink containing a leuco dye and other pigments on the ink receptive layer 3 so as to impregnate the receptive layer with the ink.

Although description was made in the above using an example for a case of forming ink receptive layer 3 containing only a developer, which is one in the thermosensitive ink components, ink receptive layer 3 may be made containing other pigments but a leuco dye. Thermosensitive coloring layers 4*a*, 4*b*, and 4*c* can be formed by printing at least a leuco dye on ink receptive layer 3.

EXAMPLE 5

In this example 5, a thermosensitive recording medium was produced by printing a water-dispersion thermosensitive ink on an ink receptive layer that contained a developer. The formation process is described below.

Formation of Ink Receptive Layer

5a) Pigment Dispersion Liquid

A pigment dispersion liquid of hydrophilic silica having an average particle size of 1.5 μm was prepared by dispersing the following compositions using a homogenizer.

| | |
|---|---|
| Hydrophilic silica<br>Nipsil E-743 (brand name), manufactured by Tosoh Silica Corp. | 20 parts |
| Calcined clay<br>KAOCAL, available from Shiraishi Kogyo Kaisha | 80 parts |
| Sodium polyacrylate (dispersant) | 1 part |

-continued

| | |
|---|---|
| Water | 340 parts |
| To prepare this coating liquid for ink receptive layer 3, the following components were added to, dispersed, and mixed in the pigment dispersion liquid prepared in the above process 5a) using a homogenizer. | |
| Styrene-butadiene copolymer latex (binder resin) | 30 parts |
| 48%-SBR dispersion liquid, manufactured by JSR | |
| Phosphate ester starch (binder resin) | 20 parts |
| MS-4600 (20% aqueous solution), manufactured by Nihon Shokuhin Kako Co., Ltd. | |
| Developer pigment dispersion liquid (40% of solid composition) | 100 parts |
| D-8 (developer), manufactured by Nippon Soda Co., Ltd. | |
| F-647 (dispersion liquid using D-8), manufactured by Chukyo Yushi Co., Ltd. | |

5c) Ink Receptive Layer

An ink receptive layer 3 was formed on substrate 2 (quality paper) having a weight of 65 g/m$^2$ by coating on the substrate with a bar coater the coating liquid prepared in the above process 5b) in an amount corresponding to a weight of 8 g/m$^2$ of the coating after dried.

Formation of Thermosensitive Coloring Layer

5d) Water-Dispersion Thermosensitive Ink

Water-dispersion thermosensitive inks of different kinds whose developing colors are blue, black and red were prepared by mixing developer dispersion liquid, sensitizer dispersion liquid, lubricant dispersion liquid, recrystalization-inhibitor dispersion liquid, calcium-carbonate-dispersion liquid, 10%-PVA dispersion liquid, surfactant, and water with leuco-dye dispersion liquid of each color of blue, black, and red, as displayed below.

| | |
|---|---|
| Leuco dye dispersion liquid (30% of solid composition) | 50 parts |
| A leuco dye dispersion liquid was prepared by adding to water a dispersant of GOHSERAN L-3266 (manufactured by The Nippon Synthetic Chemical Industry Co., Ltd.) so as to obtain 5% concentration and further adding to the liquid and dispersing each of the following leuco dyes with a sand mill to obtain an average particle size of 0.8 μm. Using each of the leuco dyes of different colors, three dispersion leuco dye liquids of blue, black, and red were prepared. | |
| Blue (CVL, manufactured by Yamamoto Chemicals Inc.) | |
| Black (OBD-2, manufactured by Yamamoto Chemicals Inc.) | |
| Red (Vermilton-DCF, manufactured by Hodogaya Chemical Co., Ltd.) | |
| Developer dispersion liquid (40% of solid composition) | 37.5 parts |
| D-8 (developer), manufactured by Nippon Soda Co., Ltd. | |
| F-647 (dispersion liquid using D-8), manufactured by Chukyo Yushi Co., Ltd. | |
| Sensitizer dispersion liquid (30% of solid composition) | 100 parts |
| To prepare this liquid, GOHSERAN L-3266 (manufactured by The Nippon Synthetic Chemical Industry Co., Ltd.) as a dispersant was added to water so as to obtain 5% concentration, and a sensitizer, indicated below, was added to it, and then the liquid was grinded using a sand mill so as to get an average particle size of 0.8 μm. | |
| HS-3520, manufactured by Dainippon Ink & Chemicals Co., Ltd. | |

-continued

| | |
|---|---|
| Lubricant dispersion liquid (30% of solid composition) | 32 parts |
| Zinc stearate: HIDRIN Z-7-30 (brand name), manufactured by Chukyo Yushi Co., Ltd. | |
| Recrystalization-inhibitor dispersion liquid (35% of solid composition) | 20 parts |
| DH43 (recrystalization-inhibitor), manufactured by Asahi Denka Co., Ltd. | |
| HYDRIN F-165 (recrystalization-inhibitor dispersion liquid), manufactured by Chukyo Yushi Co., Ltd. | |
| Calcium carbonate dispersion liquid (30% of solid component) | 50 parts |
| To prepare this dispersion liquid, GOHSERAN L-3266 (manufactured by The Nippon Synthetic Chemical Industry Co., Ltd.) as a dispersant was added to water so as to obtain 5% concentration, and a calcium carbonate, indicated below, was added to it, and then the liquid was grinded using a sand mill so as to get an average particle size of 0.8 μm. | |
| KARURAITO-KT, manufactured by Shiraishi Central Laboratories | |
| 10%-PVA solution | 53 parts |
| PVA110, manufactured by Kralle Co., Ltd. | |
| Surfactant (10% of solid composition) | 33 parts |
| ADEKACOL EC4500, manufactured by Asahi Denka Co., Ltd. | |
| Water | 25 parts |

5e) Formation of Thermosensitive Coloring Layers

Each of the water-dispersion thermosensitive inks prepared in 5d) in the above was printed on ink receptive layer 3 formed in 5c) using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When, using thermosensitive recording medium 1 that was produced in this example 5, colors were developed on thermosensitive coloring layers 4*a*, 4*b*, and 4*c* as in example 1, no striped pattern A has emerged, and a nearly uniform print surface was obtained.

Next, a protective layer was formed over thermosensitive coloring layers 4*a*, 4*b*, and 4*c* of the thermosensitive recording medium 1 by coating OCA-5, manufactured by Nippon Kayaku Co., Ltd., in 1 g/m$^2$ thick using a bar coater, and then image-recording was performed on the medium by a barcode printer KP-50 of Toshiba Tec K. K., as shown in FIG. 3. As a result, recording without irregularity in developed color density was achieved.

EXAMPLE 6

In this example 6, a thermosensitive recording medium was produced by printing a water-dispersion thermosensitive ink on an ink receptive layer to which a hydrophilic silica and calcined clay were added. The formation process is described below.

Formation of Ink Receptive Layer

6a) Pigment Dispersion Liquid

A pigment dispersion liquid of hydrophilic silica and calcined clay having an average particle size of 1.0 μm was prepared by dispersing the following compositions using a homogenizer.

| | |
|---|---|
| Hydrophilic silica<br>Nipsil E-743 (brand name), manufactured by Tosoh Silica Corp. | 20 parts |
| Calcined clay<br>KAOCAL, available from Shiraishi Kogyo Kaisha | 80 parts |
| Sodium polyacrylate (dispersant) | 1 part |
| Water | 340 parts |

6b) Coating Liquid

To prepare this coating liquid for ink receptive layer 3, the following components were added to, dispersed, and mixed in the pigment dispersion liquid prepared in the above process 6a) using a homogenizer.

| | |
|---|---|
| Styrene-butadiene copolymer latex<br>48%-SBR dispersion liquid, manufactured by JSR | 30 parts |
| Phosphate ester starch (binder resin)<br>MS-4600 (20% aqueous solution), manufactured by Nihon Shokuhin Kako Co., Ltd. | 20 parts |

6c) Ink Receptive Layer

An ink receptive layer 3 was formed on substrate 2 (quality paper) having a weight of 65 g/m$^2$ by coating on the substrate with a bar coater the coating liquid prepared in the above process 6b) in an amount corresponding to a weight of 8 g/m$^2$ of the coating after dried.

Formation of Thermosensitive Coloring Layer

6d) Water-Dispersion Thermosensitive Ink

Water-dispersion thermosensitive inks of different kinds whose developing colors are blue, black and red were prepared by mixing developer dispersion liquid, sensitizer dispersion liquid, lubricant dispersion liquid, recrystalization-inhibitor dispersion liquid, calcium-carbonate-dispersion liquid, 10%-PVA dispersion liquid, surfactant, and water with leuco-dye dispersion liquid of each color of blue, black, and red, as displayed below.

| | |
|---|---|
| Leuco dye dispersion liquid (30% of solid composition)<br>A leuco dye dispersion liquid was prepared by adding to water a dispersant of GOHSERAN L-3266 (manufactured by The Nippon Synthetic Chemical Industry Co., Ltd.) so as to obtain 5% concentration and dispersing each of the following leuco dyes using a sand mill so as to obtain an average particle size of 0.8 μm.<br>Blue (CVL, manufactured by Yamamoto Chemicals Inc.)<br>Black (OBD-2, manufactured by Yamamoto Chemicals Inc.)<br>Red (Vermilton-DCF, manufactured by Hodogaya Chemical Co., Ltd.) | 50 parts |
| Developer dispersion liquid (40% of solid composition)<br>D-8 (developer), manufactured by Nippon Soda Co., Ltd.<br>F-647 (dispersion liquid using D-8), manufactured by Chukyo Yushi Co., Ltd. | 75 parts |
| Sensitizer dispersion liquid (30% of solid composition)<br>To prepare this liquid, GOHSERAN L-3266 (manufactured by The Nippon Synthetic Chemical Industry Co., Ltd.) as a dispersant was added to water so as to obtain 5% concentration, and a sensitizer, indicated below, was added to it, and then the liquid was grinded using a sand mill so as to get an average particle size of 0.8 μm.<br>HS-3520, manufactured by Dainippon Ink & Chemicals Co., Ltd. | 100 parts |

-continued

| | |
|---|---|
| Lubricant dispersion liquid (30% of solid composition)<br>Zinc stearate: HIDRIN Z-7-30 (brand name), manufactured by Chukyo Yushi Co., Ltd. | 32 parts |
| Recrystalization-inhibitor dispersion liquid (35% of solid composition)<br>DH43 (recrystalization-inhibitor), manufactured by Asahi Denka Co., Ltd.<br>HYDRIN F-165 (recrystalization-inhibitor dispersion liquid), manufactured by Chukyo Yushi Co., Ltd. | 20 parts |
| Calcium carbonate dispersion liquid (30% of solid component)<br>To prepare this dispersion liquid, GOHSERAN L-3266 (manufactured by The Nippon Synthetic Chemical Industry Co., Ltd.) as a dispersant was added to water so as to obtain 5% concentration, and a calcium carbonate, indicated below, was added to it, and then the liquid was grinded using a sand mill so as to get an average particle size of 0.8 μm.<br>KARURAITO-KT, manufactured by Shiraishi Central Laboratories | 50 parts |
| 10%-PVA solution<br>PVA110, manufactured by Kralle Co., Ltd. | 53 parts |
| Surfactant (10% of solid composition)<br>ADEKACOL EC4500, manufactured by Asahi Denka Co., Ltd. | 33 parts |
| Water | 25 parts |

6e) Formation of Thermosensitive Coloring Layers

The water-dispersion thermosensitive inks prepared in 6d) in the above were printed on ink receptive layer 3 formed in 6c) using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When, using thermosensitive recording medium 1 that was produced in this example 6, colors were developed on thermosensitive coloring layers 4*a*, 4*b*, and 4*c* as in example 1, no striped pattern A has emerged, and a nearly uniform print surface was obtained.

Next, a protective layer was formed over thermosensitive coloring layers 4*a*, 4*b*, and 4*c* of the thermosensitive recording medium 1 by coating OCA-5, manufactured by Nippon Kayaku Co., Ltd., in 1 g/m$^2$ thick using a bar coater, and then image-recording was performed on the medium by a barcode printer KP-50 of Toshiba Tec K. K., as shown in FIG. 3. As a result, recording without irregularity in developed color density was achieved.

EXAMPLE 7

In this example 7, a thermosensitive recording medium was produced by printing a water-dispersion ink on an ink receptive layer to which a hydrophilic silica, calcined clay, developer, and sensitizer were added. The formation process is described below.

Formation of Ink Receptive Layer

7a) Pigment Dispersion Liquid

A pigment dispersion liquid of hydrophilic silica and calcined clay having an average particle size of 1.0 μm was prepared by dispersing the following compositions using a homogenizer.

| | |
|---|---|
| Hydrophilic silica<br>Nipsil E-743 (brand name), manufactured by Tosoh Silica Corp. | 20 parts |
| Calcined clay<br>KAOCAL, available from Shiraishi Kogyo Kaisha | 80 parts |
| Sodium polyacrylate (dispersant) | 1 part |
| Water | 340 parts |

7b) Coating Liquid

To prepare this coating liquid for ink receptive layer 3, the following components were added to, dispersed, and mixed in the pigment dispersion liquid prepared in the above process 7a) using a homogenizer.

| | |
|---|---|
| Styrene-butadiene copolymer latex<br>48%-SBR dispersion liquid, manufactured by JSR | 30 parts |
| Phosphate ester starch (binder resin)<br>MS-4600 (20% aqueous solution), manufactured by Nihon Shokuhin Kako Co., Ltd. | 20 parts |
| Developer pigment dispersion liquid (40% of solid composition)<br>D-8 (developer), manufactured by Nippon Soda Co., Ltd.<br>F-647 (dispersion liquid using D-8), manufactured by Chukyo Yushi Co., Ltd. | 100 parts |
| Sensitizer dispersion liquid (30% of solid composition)<br>To prepare this liquid, GOHSERAN L-3266 (manufactured by The Nippon Synthetic Chemical Industry Co., Ltd.) as a dispersant was added to water so as to obtain 5% concentration, and a sensitizer, indicated below, was added to it, and then the liquid was grinded using a sand mill so as to get an average particle size of 0.8 μm.<br>HS-3520, manufactured by Dainippon Ink & Chemicals Co., Ltd. | 133 parts |
| Lubricant dispersion liquid (30% of solid composition)<br>Zinc stearate: HIDRIN Z-7-30 (brand name), manufactured by Chukyo Yushi Co., Ltd. | 32 parts |
| Recrystalization-inhibitor dispersion liquid (35% of solid composition)<br>DH43 (recrystalization-inhibitor), manufactured by Asahi Denka Co., Ltd.<br>HYDRIN F-165 (recrystalization-inhibitor dispersion liquid), manufactured by Chukyo Yushi Co., Ltd. | 20 parts |

7c) Ink Receptive Layer

An ink receptive layer 3 was formed on substrate 2 (quality paper) having a weight of 65 g/m$^2$ by coating on the substrate with a bar coater the coating liquid prepared in the above process 7b) in an amount corresponding to a weight of 8 g/m$^2$ of the coating after dried.

Formation of Thermosensitive Coloring Layer

7d) Water-Dispersion Ink

Water-dispersion inks of different kinds whose developing colors are blue, black and red were prepared by mixing 10%-PVA dispersion liquid, surfactant, and water with leuco-dye dispersion liquid of each color of blue, black, and red, as displayed below.

| | |
|---|---|
| Leuco dye dispersion liquid (30% of solid composition)<br>A leuco dye dispersion liquid was prepared by adding to water a dispersant of GOHSERAN L-3266 (manufactured by The Nippon Synthetic Chemical Industry Co., Ltd.) to obtain 5% concentration and dispersing each of the following leuco dyes using a sand mill so as to obtain an average particle size of 0.8 μm.<br>Blue (CVL, manufactured by Yamamoto Chemicals Inc.)<br>Black (OBD-2, manufactured by Yamamoto Chemicals Inc.)<br>Red (Vermilton-DCF, manufactured by Hodogaya Chemical Co., Ltd.) | 50 parts |

-continued

| | |
|---|---|
| 10%-PVA solution<br>PVA110, manufactured by Kralle Co., Ltd. | 53 parts |
| Surfactant (10% of solid composition)<br>ADEKACOL EC4500, manufactured by Asahi Denka Co., Ltd. | 33 parts |
| Water | 25 parts |

7e) Formation of Thermosensitive Coloring Layers

These water-dispersion inks prepared in 7d) in the above was printed on ink receptive layer 3 formed in 7c) using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When, using thermosensitive recording medium 1 that was produced in this example 7, colors were developed on thermosensitive coloring layers 4*a*, 4*b*, and 4*c* as in example 1, no striped pattern A has emerged, and a nearly uniform print surface was obtained.

Next, a protective layer was formed over thermosensitive coloring layers 4*a*, 4*b*, and 4*c* of the thermosensitive recording medium 1 by coating OCA-5, manufactured by Nippon Kayaku Co., Ltd., in 1 g/m$^2$ thick using a bar coater, and then image-recording was performed on the medium by a barcode printer KP-50 of Toshiba Tec K. K., as shown in FIG. 3. As a result, recording without irregularity in developed color density was achieved.

EXAMPLE 8

In this example 8, a thermosensitive recording medium was produced by printing a water-dispersion ink to which a sensitizer was added on the ink receptive layer to which a hydrophilic silica, calcined clay, developer were added. The formation process is described below.

Formation of Ink Receptive Layer

8a) Pigment Dispersion Liquid

A pigment dispersion liquid of hydrophilic silica and calcined clay having an average particle size of 1.0 μm was prepared by dispersing the following compositions using a homogenizer.

| | |
|---|---|
| Hydrophilic silica<br>Nipsil E-743 (brand name), manufactured by Tosoh Silica Corp. | 20 parts |
| Calcined clay<br>KAOCAL, available from Shiraishi Kogyo Kaisha | 80 parts |
| Sodium polyacrylate (dispersant) | 1 part |
| Water | 340 parts |

8b) Coating Liquid

To prepare this coating liquid for ink receptive layer 3, the following components were added to, dispersed, and mixed in the pigment dispersion liquid prepared in the above process 8a) using a homogenizer.

| | |
|---|---|
| Styrene-butadiene copolymer latex (binder resin)<br>48%-SBR dispersion liquid, manufactured by JSR | 30 parts |
| Phosphate ester starch<br>MS-4600 (20% aqueous solution), manufactured by Nihon Shokuhin Kako Co., Ltd. | 20 parts |

-continued

| | |
|---|---|
| Developer pigment dispersion liquid (40% of solid composition) | 100 parts |
| D-8 (developer), manufactured by Nippon Soda Co., Ltd. | |
| F-647 (dispersion liquid using D-8), manufactured by Chukyo Yushi Co., Ltd. | |
| Lubricant dispersion liquid (30% of solid composition) | 32 parts |
| Zinc stearate: HIDRIN Z-7-30 (brand name), manufactured by Chukyo Yushi Co., Ltd. | |
| Recrystalization-inhibitor dispersion liquid (35% of solid composition) | 20 parts |
| DH43 (recrystalization-inhibitor), manufactured by Asahi Denka Co., Ltd. | |
| HYDRIN F-165 (recrystalization-inhibitor dispersion liquid), manufactured by Chukyo Yushi Co., Ltd. | |

8c) Ink Receptive Layer

An ink receptive layer 3 was formed on a substrate 2 (quality paper) having a weight of 65 g/m$^2$ by coating over the substrate with a bar coater the coating liquid prepared in the above process 8b) in an amount corresponding to a weight of 8 g/m$^2$ of the coating after dried.

Formation of Thermosensitive Coloring Layer

8d) Water-Dispersion Ink

Water-dispersion inks of different kinds whose developing colors are blue, black and red were prepared by mixing sensitizer dispersion liquid, 10%-PVA dispersion liquid, surfactant, and water with leuco-dye dispersion liquid of each color of blue, black, and red, as displayed below.

| | |
|---|---|
| Leuco dye dispersion liquid (30% of solid composition) | 50 parts |
| A leuco dye dispersion liquid was prepared by adding to water a dispersant of GOHSERAN L-3266 (manufactured by The Nippon Synthetic Chemical Industry Co., Ltd.) so as to obtain 5% concentration and dispersing each of the following leuco dyes using a sand mill so as to obtain an average particle size of 0.8 μm. | |
| Blue (CVL, manufactured by Yamamoto Chemicals Inc.) | |
| Black (OBD-2, manufactured by Yamamoto Chemicals Inc.) | |
| Red (Vermilton-DCF, manufactured by Hodogaya Chemical Co., Ltd.) | |
| Sensitizer dispersion liquid (30% of solid composition) | 100 parts |
| To prepare this sensitizer dispersion liquid, GOHSERAN L-3266 (manufactured by The Nippon Synthetic Chemical Industry Co., Ltd.) as a dispersant was added to water so as to obtain 5% concentration, and a sensitizer, indicated below, was dispersed using a sand mill so as to get an average particle size of 0.8 μm. HS-3520, manufactured by Dainippon Ink & Chemicals Co., Ltd. | |
| 10%-PVA solution | 53 parts |
| PVA110, manufactured by Kralle Co., Ltd. | |
| Surfactant (10% of solid composition) | 33 parts |
| This surfactant solution of 10% solid composition was produced by mixing the following constituents in the ratio by solid components shown below: | |
| ADEKACOL EC4500, manufactured by Asahi Denka Co., Ltd. 2 SURFYNOL 485, manufactured by Air Products, Inc. 1 | |
| DYNOL 604, manufactured by Air Products, Inc. 1 | |
| Water | 25 parts |

8e) Formation of Thermosensitive Coloring Layers

These water-dispersion inks prepared in 8d) in the above were printed on ink receptive layer 3 formed in 8c) using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When, using thermosensitive recording medium 1 that was produced in this example 8, colors were developed on thermosensitive coloring layers 4*a*, 4*b*, and 4*c* as in example 1, no striped pattern A has emerged, and a nearly uniform print surface was obtained.

Next, a protective layer was formed over thermosensitive coloring layers 4*a*, 4*b*, and 4*c* of the thermosensitive recording medium 1 by coating OCA-5, manufactured by Nippon Kayaku Co., Ltd., in 1 g/m$^2$ thick using a bar coater, and then image-recording was performed on the medium by a barcode printer KP-50 of Toshiba Tec K. K., as shown in FIG. 3. As a result, recording without irregularity in developed color density was achieved.

COMPARATIVE EXAMPLE 1

Ink receptive layer 3 was formed in the exactly same fashion as in example 1 except that the pigment dispersion liquid of hydrophilic silica was dispersed using Paint Shaker (of Seiwa Giken) to make the average particle size of the hydrophilic silica to 0.5 μm. Each of the water-dispersion thermosensitive inks that are prepared in example 1 was printed on this ink receptive layer 3 using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When this thermosensitive recording medium 1 was held at 130 degree C. in an oven for five minutes so as to develop colors, striped pattern A has appeared.

COMPARATIVE EXAMPLE 2

Ink receptive layer 3 was formed in the exactly same fashion as in comparative example 1 except for use of calcined clay (KAOCAL, available from Shiraishi Kogyo Kaisha Ltd.) having an average particle size of 0.5 μm in place of the hydrophilic silica in comparative example 1. Each of the water-dispersion thermosensitive inks that are prepared in example 1 was printed on this ink receptive layer 3 using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When this thermosensitive recording medium 1 was held at 130 degree C. in an oven for five minutes so as to develop colors, striped pattern A has appeared.

COMPARATIVE EXAMPLE 3

Ink receptive layer 3 was formed in the exactly same fashion as in comparative example 1 except for use of a porous calcium carbonate (KARURAITO-KT, manufactured by Shiraishi Central Laboratories) having an average particle size of 0.5 μm in place of the hydrophilic silica in comparative example 1. Each of the water-dispersion thermosensitive inks that are prepared in example 1 was printed on this ink receptive layer 3 using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced.

When this thermosensitive recording medium 1 was held at 130 degree C. in an oven for five minutes so as to develop colors, striped pattern A has appeared.

COMPARATIVE EXAMPLE 4

Each of the water-dispersion thermosensitive inks that are prepared in example 1 was printed on EPSON SUPER-FINE type MJA4SP1, an ink jet printing paper, using a simplified photogravure printing machine (K Printing Proofer, available from Matsuo Sangyo Co., Ltd.), equipped with an etched plate having 175 lines in cell density and 34 μm in cell depth, so that thermosensitive recording medium 1 as illustrated in FIG. 1 was produced. When this thermosensitive recording medium 1 was held at 130 degree C. in an oven for five minutes so as to develop colors, striped pattern A has appeared.

COMPARATIVE EXAMPLE 5

Each of the water-dispersion thermosensitive inks prepared in example 1 was printed on a quality paper (substrate 2) that was used in example 1 on which ink receptive layer 3 was not provided, using a simplified photogravure printing machine (K Printing Proofer, available from Matsuo Sangyo Co., Ltd.), equipped with an etched plate having 175 lines in cell density and 34 μm in cell depth, so that a thermosensitive recording medium having a thermosensitive coloring layers was produced. When this thermosensitive recording medium was held at 130 degree C. in an oven for five minutes so as to develop colors, striped pattern A has appeared.

<Evaluation>

Method

A water-dispersion thermosensitive ink or water-dispersion ink was printed by the simplified photogravure printing machine (K Printing Proofer, available from Matsuo Sangyo Co., Ltd.), using printing plates (etched plates) of 175 lines/34 μm in cell depth; 150 lines/40 μm in cell depth; 133 lines/45 in cell depth; and 100 lines/61 in cell depth, and the number of lines with which a water-dispersion thermosensitive ink or water-dispersion ink could be printed without showing "streaking" was examined. Herein, the number of printing lines corresponds to an amount of coating of a water-dispersion thermosensitive ink or water-dispersion ink; it means that the fewer the number of lines is, the more amount of coating is provided. Combination of the ink receptive layer and a water-dispersion thermosensitive ink or water-dispersion ink were arranged as follows: the black water-dispersion thermosensitive ink prepared in example 1 was printed on the respective ink receptive layers 3 formed in examples 1, 2, 3, comparative examples 1, 2, 3, and 4, and on the quality paper used in comparative example 5; the black water-dispersion ink prepared in example 4 was printed on ink receptive layer 3 formed in example 4; black water-dispersion thermosensitive inks prepared in the respective examples were printed on ink receptive layers 3 formed in examples 5 and 6; and black water-dispersion inks prepared in the respective examples on ink receptive layers 3 formed in examples 7 and 8.

Printings were evaluated visually and by measurements of a color density. Thermal sensitive recording media that have been produced for examining states of printing were held in an oven at 130 degree C. for five minutes so as to develop colors, and were visually examined for a degree of development of "streaking." For the measurements of optical density, Mackbeth reflection type densitometer RD-19 was used.

Figure 3:
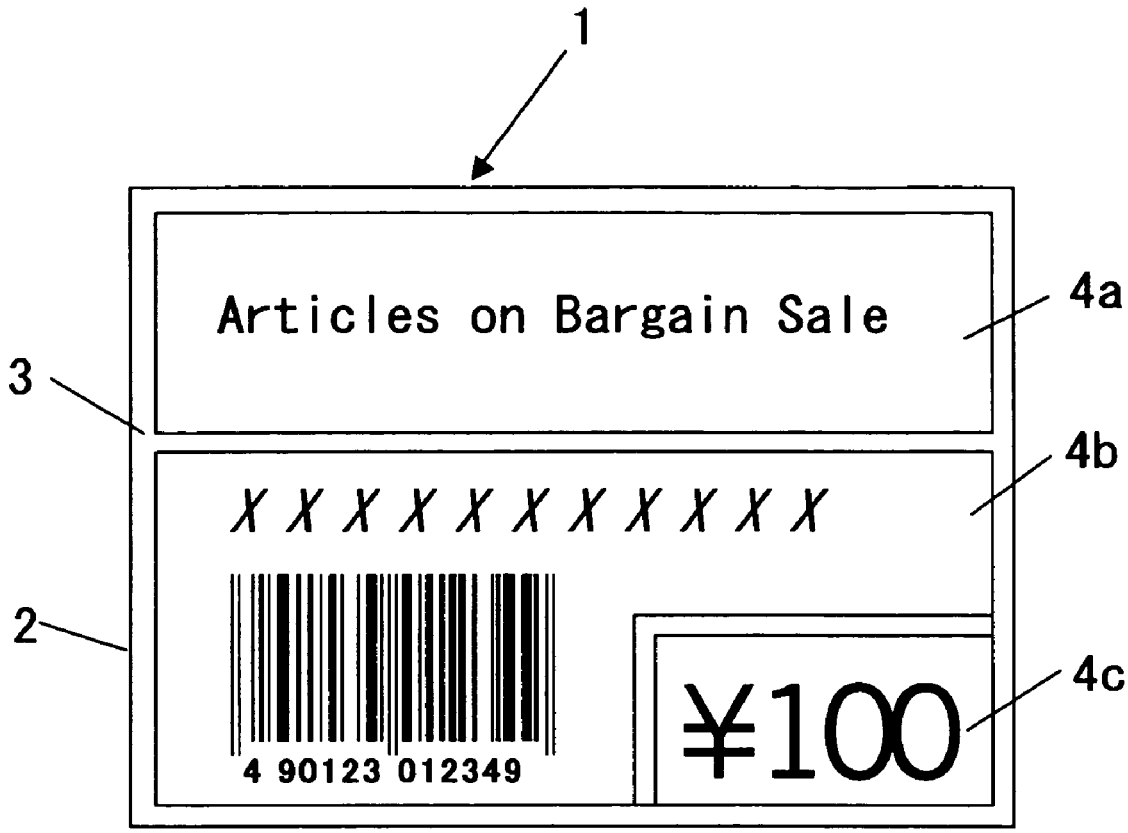
FIG. 3 is a plane view showing a state of recording on the thermosensitive recording medium in the first embodiment.
Figure 4:
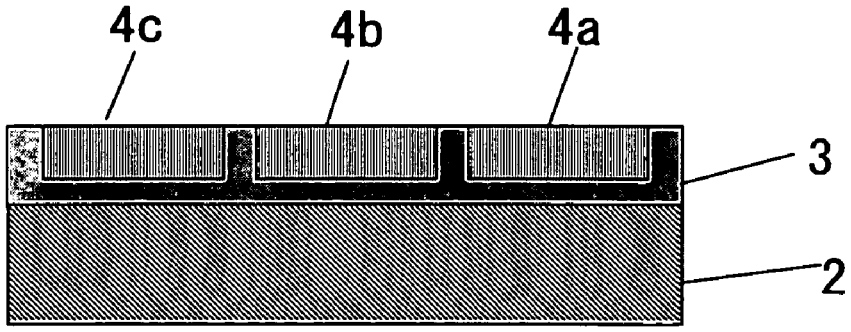
FIG. 4 is a cross-sectional view of a variation of the thermosensitive recording medium in the first embodiment.

For evaluation in respect to image/character recordings on the media samples, after recordings were made on the media by Toshiba Tec barcode printer KP-50, as shown in FIG. 3, an allowable least number of lines of a printing plate at which irregularity in color development could be hardly observed was visually determined.

Test Result

Evaluation Result

Table 1 below shows results of the above evaluations and characteristics of each pigment contained in ink receptive layer 3. Overall judgment in each case was made in terms of a degree of "streaking" and a color density.

TABLE 1

| | Condition of Ink Receptive Layer | | Result of Printing | | | Result of Recording | |
|---|---|---|---|---|---|---|---|
| | Pigment in ink receptive layer | Av'g particle size of pigment in receptive layer (μm) | Number of lines without having Streaking | Number of lines where Streaking begins to occur | O.D. with a printing plate of 175 lines | Number of line without irregular color density | Overall Judgment |
| Example 1 | E743 | 1.5 | 175 | 150 | 1.1 | 150 | Excellent |
| Example 2 | KAOCAL | 0.9. | none | 175 | 1.0 | 175 | Good |
| Example 3 | KARUR-AITO-KT | 2.6 | none | 175 | 1.1 | 175 | Good |
| Example 4 | E743 | 1.5 | none | 175 | 1.0 | 175 | Good |
| Example 5 | E743/KA-OCAL | 1.0 | none | 175 | 1.4 | 175 | Excellent |
| Example 6 | E743/KA-OCAL | 1.0 | none | 175 | 1.0 | 175 | Good |
| Example 7 | E743/KA-OCAL | 1.0 | none | 175 | 1.3 | 175 | Good |
| Example 8 | E743/KA-OCAL | 1.0 | none | 175 | 1.4 | 175 | Excellent |
| Comparative Example 1 | E743 | 0.5 | none | Streaking distinctly occurred even with 175 lines | 1.0 | Not Acceptable for all lines | Not Acceptable |

TABLE 1-continued

| | Condition of Ink Receptive Layer | | Result of Printing | | | Result of Recording | |
|---|---|---|---|---|---|---|---|
| | Pigment in ink receptive layer | Av'g particle size of pigment in receptive layer (μm) | Number of lines without having Streaking | Number of lines where Streaking begins to occur | O.D. with a printing plate of 175 lines | Number of line without irregular color density | Overall Judgment |
| Comparative Example 2 | KAOCAL AITO-KT | 0.5 | none | Streaking distinctly occurred even with 175 lines | 0.9 | Not Acceptable for all lines | Not Acceptable |
| Comparative Example 3 | KARUR-AITO-KT | 0.5 | none | Streaking distinctly occurred even with 175 lines | 0.9 | Not Acceptable for all lines | Not Acceptable |
| Comparative Example 4 | — | — | none | Streaking distinctly occurred even with 175 lines | 0.9 | Not Acceptable for all lines | Not Acceptable |
| Comparative Example 5 | — | — | none | Streaking distinctly occurred even with 175 lines | 0.8 | Not Acceptable for all lines | Not Acceptable |

Thermosensitive coloring layers were formed according to ways shown in the respective examples by a process of printing a water-dispersion thermosensitive ink or water-dispersion ink, and each of the formed samples was evaluated. The less the number of lines of a printing plate is used, the more the amount of coating of the water-dispersion thermosensitive ink or water-dispersion ink is to be applied in the printing process; and as the amount of the coating increases, possibility of occurrence of "Streaking" increases. In example 1, "Streaking" did not occur with 175 lines of a printing plate, but it began to occur with 150 lines. Although "Streaking" appeared with 175 lines in both examples 2 though 8, and comparative examples 1 though 5, it was not highly visible in those examples but appeared remarkable in the comparative examples.

As in comparative examples 1, 2, and 3, wherein the pigments whose average particle sizes were smaller than that of pigments (0.8 μm) in the water-dispersion thermosensitive ink were used in the ink receptive layers, "striped pattern A" appeared with all printing plates. Also, in comparative example 5, wherein an ink receptive layer was not provided, "striped pattern A" appeared with all printing plates. Whereas, in the ink receptive layers in examples 1 through 8 wherein pigments were used in the layers whose average particle sizes were larger than the average particle size of pigments (0.8 μm) in the water-dispersion thermosensitive ink or water-dispersion ink, printing with 175 lines of a printing plate was achieved. Although states of printing in examples 2 and 3 showed nearly the same, the O.D. value in example 3 exhibited higher than the other. This is because the ink receptive layer in example 3 containing a porous pigment absorbed more of the water-dispersion thermosensitive ink than the other did. In example 1, printing using 150 lines of a printing plate was made possible. This is because a porous hydrophilic pigment was used in the ink receptive layer, and therefore, more of the water-dispersion thermosensitive ink could be contained in the layer than that in examples 2 and 3.

When comparing example 5 to example 6, the O.D. value in example 5 showed higher. This is because amount of the developer was insufficient in example 6. If, in pursue of maximizing the density, a ratio of the developer to the leuco dye contained in the water-dispersion thermosensitive ink is increased to a sufficient degree, the relative amount of the leuco dye consequently becomes reduced because the amount of the coating to be printed remains constant. This means that significant improvement of the density is difficult unless a total amount of coating by printing is made to increase. In view of this problem, the inventors have conceived a way to increase the amount of the leuco dye in the water-dispersion thermosensitive ink by making the developer to be contained in ink receptive layer 3 supplementing the developer in the thermosensitive coloring layers, and experimented the idea successfully in example 5. As a result, it could be achieved to increase color density without the need of increasing amount of the ink coating by printing.

Figure 6:
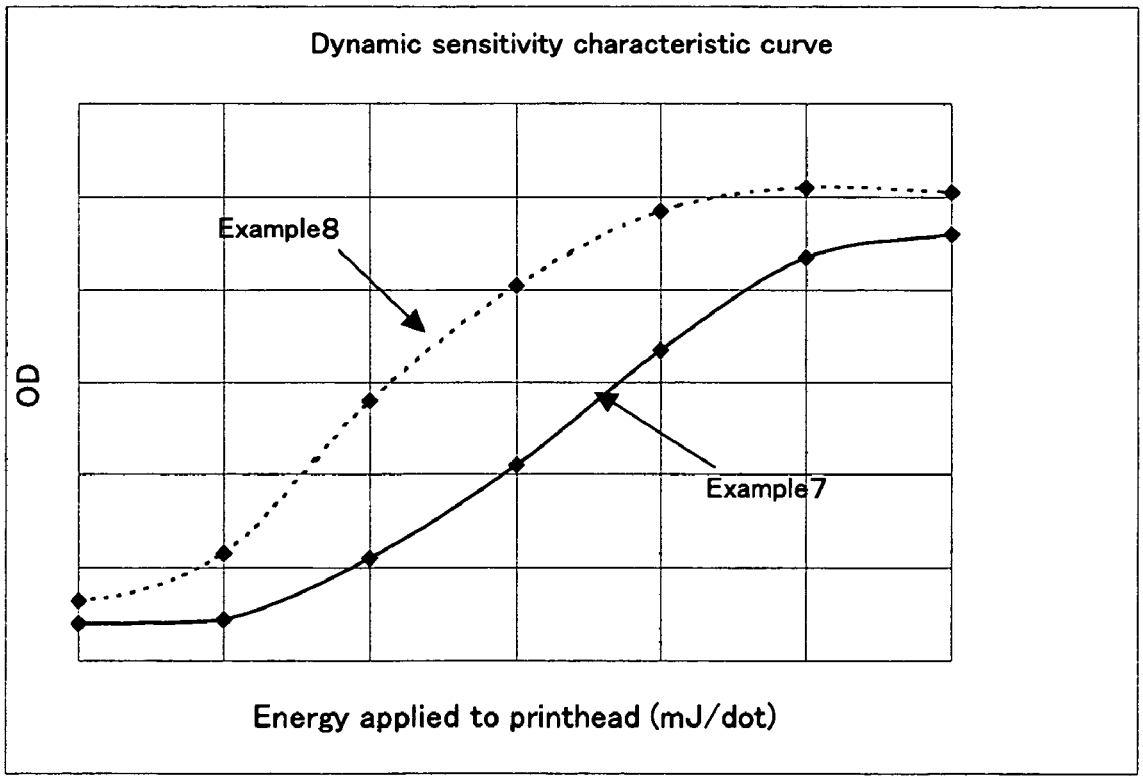
FIG. 6 is a graph indicating a dynamic coloring sensitivity of the thermosensitive recording medium in examples 7 and 8 when the medium developed color by a thermal printer.

FIG. 6 shows a dynamic sensitivity characteristic curve in recording on the thermosensitive recording mediums formed in examples 7 and 8 using a thermal printer. In example 7, a sensitizer was made to be contained in the ink receptive layer; while, in example 8, a sensitizer was added to the water-dispersion ink. As a result, the thermosensitive recording medium in example 8 reached its saturation point in color development with lower energy than in example 7. This can be explained because, if the water-dispersion ink containing the sensitizer is printed to form the thermosensitive coloring layer, more sensitizer is likely to exist on the upper surface (where a thermal printhead contacts) of the thermosensitive coloring layer comparing to the other way. For this reason, if the same energy applied to both of the media by a thermal printhead, more sensitizer is likely to be melted in the media of example 8. Accordingly, color-development in the medium in example 8 saturates at lower energy. Therefore, it is more preferable to make the sensitizer to be contained in the water-dispersion thermosensitive ink or water-dispersion ink rather than to be done in the ink receptive layer.

In image-recordings by a printer, density irregularity in images formed by a thermal printhead did not appear distinctively with up to the number of printing lines where "streaking" would have begun to occur. Accordingly, printing with a printing plate having the number of lines with which "streaking" just begins to appear can be practically made.

In comparative example 4, ink jet recording papers available on the market were tested. In ink jet recording papers, an ink receptive layer is typically formed on a surface of the paper with a coating of an excellent water-absorbable material. Nevertheless, in the tests, the striped pattern appeared on the papers with all types of a printing plate. This can be explained as follows. Ink jet recording papers, although they are made of a water-absorbable material, are typically designed to retard the pigment component penetrating the ink receptive layer so that some of pigment component remain on a surface of the ink receptive layer after recording, thereby holding recording density high. This design scheme was contemplated on the base that ink jet recording uses a little ink. However, if a large quantity of a water-dispersion thermosensitive ink or water-dispersion ink is printed on such ink jet paper by means of a printing process such as gravure printing, the pigment component deposits on a surface-of the ink receptive layer. Consequently, ink-absorbability of the ink receptive layer is acutely lowered, leading to development of "striped pattern." Such characteristics of ink jet recording papers are unsuitable for use in the present invention, because the invention initially intended to acquire higher color density on thermosensitive coloring layers, and therefore a large quantity of a water-dispersion thermosensitive ink is required in a printing process such as gravure printing.

The multicolor thermosensitive recording medium in the present invention realizes inexpensive thermosensitive coloring layers that develop more than one color without laminating layers on one plane. Because this multicolor thermosensitive coloring layers can record images of multi colors at one intensity level in heat energy, sophisticated control for recording is not required. In addition, this multicolor thermosensitive recording medium does not hold such a problem because the thermosensitive coloring layers each developing different color are formed in divided regions on one plane, while the conventional two-color thermosensitive coloring paper having laminated thermosensitive coloring layers that develop colors at different temperatures of heat has a problem in mixing colors on recording by a thermal printhead. Furthermore, this medium enables high-speed recordings as conventional mono-color thermosensitive recording papers do, and there is no fear of shortening a life of a thermal printhead as has been one in recording with the conventional two-color thermosensitive recording paper.

Second Embodiment

In the first embodiment, there has been proposed the thermosensitive recording medium having thermosensitive coloring layers which are formed integrally with an ink receptive layer by impregnating the ink receptive layer with a water-dispersion thermosensitive ink or water-dispersion ink, and practically sufficient performance of the medium has been demonstrated in the forgoing. However, when attempting to increase heat energy applied to a medium by a thermal printhead where coloring sensitivity is insufficient, some voids (white blotches) tend to appear on the medium. They occur because, where coloring sensitivity is insufficient, an irregular surface of an ink receptive layer is subject to nonuniform transmission of heat energy, and parts where insufficient heat has been received are turned to be white blotches. Where a higher stable quality of recordings is demanded, occurrence of this problem should be diminished.

The thermosensitive recording medium in the second embodiment is produced such that: first, an ink receptive layer is formed on a surface of a substrate; then, a thermosensitive coloring layer is formed integrally with the ink receptive layer such that the ink receptive layer is impregnated with a water-dispersion thermosensitive ink which is prepared by dipersing in water a pigment component that contains at least an electron-accepting compound and electron-donating compound; and an auxiliary coloring layer containing at least one of an electron-accepting compound and a sensitizer is formed on the thermosensitive coloring layer. By providing the auxiliary coloring layer on the medium, occurrence of the above-mentioned voids can be suppressed.

Figure 7:
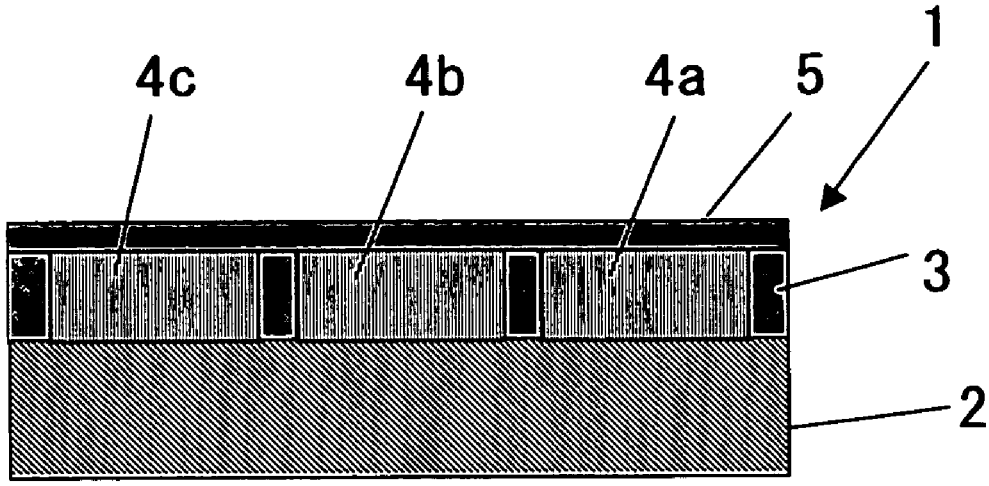
FIG. 7 is a plane view showing a state of recording on the thermosensitive recording medium in the second embodiment.

Thermosensitive recording medium 1 shown in FIG. 7 comprises: a substrate 2; an ink receptive layer 3 formed on substrate 2; thermosensitive coloring layers 4*a*, 4*b*, and 4*c* formed in ink receptive layer 3, each thermosensitive coloring layer developing a color different from others; and an auxiliary coloring layer 5. If needed, a protective layer may be formed over the auxiliary coloring layer.

Auxiliary coloring layer 5 indicated in FIG. 7 contains an electron-accepting compound, a sensitizer that contributes to improving the coloring sensitivity of thermosensitive coloring layers 4*a*, 4*b*, and 4*c*, and a binder resin. The electron-accepting compound (for example, a developer) may choose from materials described in the first embodiment. They may be used individually or by combining two or more of them.

A sensitizer contributes to improving coloring sensitivity of the coloring layer by binding an electron-accepting compound and electron-donating compound. Although an ideal material for the sensitizer differs depending on an electron-accepting compound and electron-donating compound that are used, for example, a sensitizer HS-3520, manufactured by Dainippon Ink & Chemicals Co., Ltd. may be used.

For a binder resin for the auxiliary coloring layer, those binder resins forming the ink receptive layer as described in the first embodiment can be used.

If necessary, a printhead abrasion resistance agent or anti-sticking agent, such as zinc stearate, amide stearate, calcium carbonate, may be added to auxiliary coloring layer 5.

Auxiliary coloring layer 5 is formed such that, first, a water-dispersion ink is prepared by mixing materials that constitute the auxiliary coloring layer, and the prepared ink is coated over the ink receptive layer or thermosensitive coloring layers using a coater.

The water-dispersion ink forming the auxiliary coloring layer is prepared by dispersing and mixing in water an electron-accepting compound (for example, a developer), sensitizer, and binder resin. During this process, if needed, various additives such as a modified resin such as denatured sulfonic polyvinyl alcohol, dispersant such as a surfactant, defoamer, ultraviolet absorbent, antiseptic, printhead abrasion resistance agent, and anti-sticking agent may be mixed in the ink.

Auxiliary coloring layer 5 is formed by coating the water-dispersion ink prepared in the above using a coater in an amount corresponding to a weight of the coating after dried of between 0.5 and 10 g/m$^2$, preferably between 1 and 5 g/m$^2$. The coater to be used in this process may be selected from an air knife coater, bar coater, roll coater, blade coater, gravure coater, etc. If needed, levelling may also be made using a calender. If the amount of the coating on auxiliary coloring layer 5 is a little, a photogravure printing machine or the like in stead of coaters in the above may be used.

Figure 8:
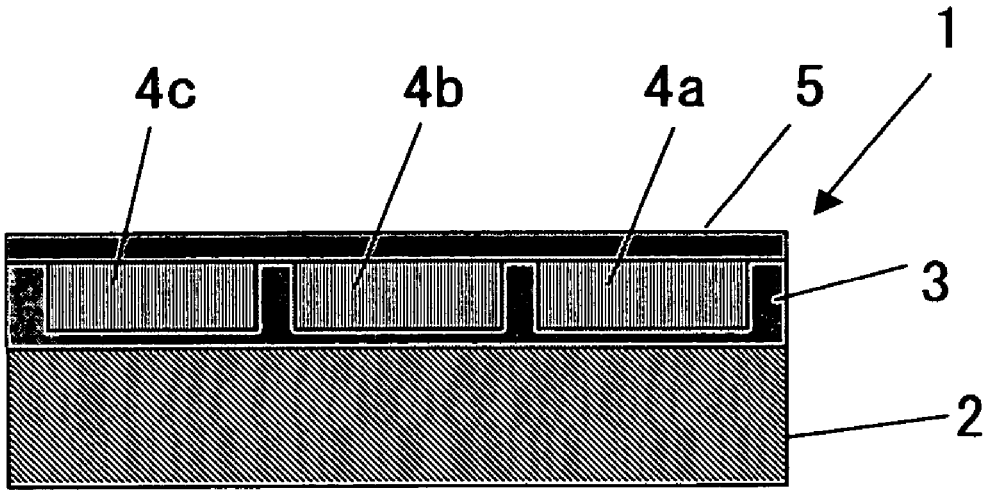
FIG. 8 is a cross-sectional view of one variation of the thermosensitive recording medium in the second embodiment.
Figure 9:
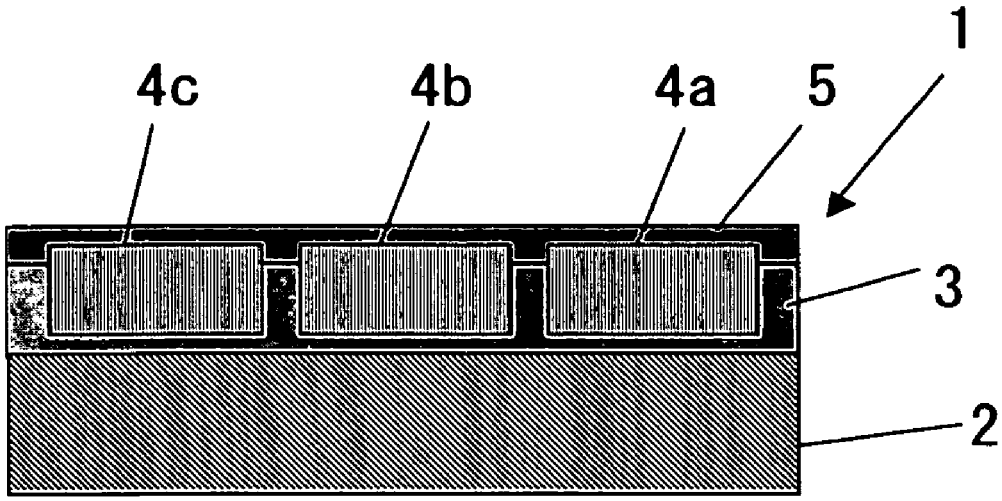
FIG. 9 is a cross-sectional view of another variation of the thermosensitive recording medium in the second embodiment.

In this embodiment, description has been made using an example assuming that the thickness of ink receptive layer 3 coincides with that of thermosensitive coloring layers 4*a*, 4*b*, and 4*c*, as illustrated in FIG. 7. If a required color density is obtained in recording by a thermal printhead on the thermosensitive recording medium, the auxiliary coloring layer may be formed over the coloring layers, as shown in FIG. 8, after each of the thermosensitive coloring layers is formed thinner than ink receptive layer 3.

Where color density is particularly wanted, the thickness of thermosensitive coloring layers 4*a*, 4*b*, and 4*c* may be increased higher than that of ink receptive layer 3, and then auxiliary coloring layer 5 is provided over the coloring layers, as shown in FIG. 9. However, in the case that thermosensitive coloring layers are thicker than ink receptive layer 3, it should be borne in mind that, as a thickness of a water-dispersion thermosensitive ink layer increases, possibility of developing striped pattern A increases. Therefore, it is preferable that receptive layer 3 is impregnated with the water-dispersion ink to such a degree that the ink does not overflow from the ink receptive layer 3.

Figure 10:
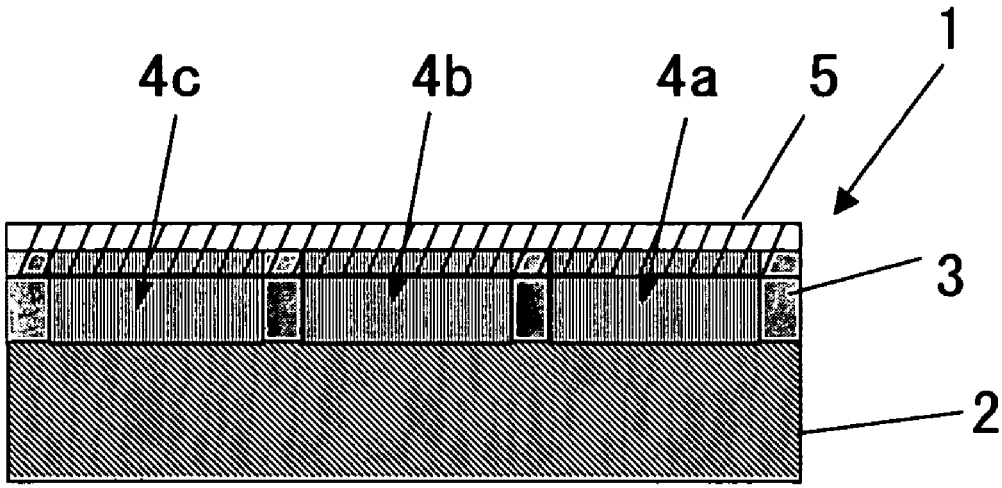
FIG. 10 is a cross-sectional view of still another variation of the thermosensitive recording medium in the second embodiment.
Figure 11:
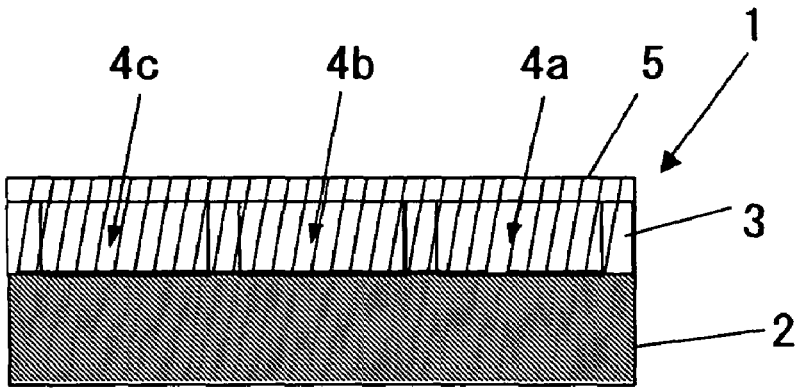
FIG. 11 is a cross-sectional view of a further variation of the thermosensitive recording medium in the second embodiment.

Auxiliary coloring layer 5 may be penetrated partially into ink receptive layer 3, as shown in FIG. 10. It also works effectively when much of the auxiliary coloring layer is penetrated into ink receptive layer 3 as shown in FIG. 1, as the thermosensitive coloring layers 4 do.

EXAMPLE 9

Formation of Ink Receptive Layer

9a) Pigment Dispersion Liquid

A pigment dispersion liquid of hydrophilic silica was prepared by dispersing the following compositions using a homogenizer.

| | |
|---|---|
| Calcined kaolin<br>KAOCAL (brand name), available from Shiraishi Kogyo Kaisha Ltd. | 100 parts |
| Hydrophilic silica<br>Nipsil E-220A (brand name), manufactured by Tosoh Silica Corp. | 11 parts |
| Sodium polyacrylate (dispersant) | 1 part |
| Water | 280 parts |

9b) Coating Liquid

A coating liquid for ink receptive layer 3 was prepared by adding the following components to, dispersing, and mixing in the pigment dispersion liquid prepared in the above process 9a) using a homogenizer.

| | |
|---|---|
| Styrene-butadiene copolymer latex<br>48%-SBR dispersion liquid, manufactured by JSR | 55 parts |
| Phosphate ester starch<br>MS-4600 (20% aqueous solution), manufactured by Nihon Shokuhin Kako Co., Ltd. | 37 parts |

9c) Ink Receptive Layer

An ink receptive layer 3 was formed on substrate 2 (quality paper) having a weight of 65 g/m$^2$ by coating with a bar coater the coating liquid prepared in the above process 9b) in an amount corresponding to a weight of 8 g/m$^2$ of the coating after dried.

Formation of Thermosensitive Coloring Layer

9d) Water-Dispersion Thermosensitive Ink

Water-dispersion thermosensitive inks of three kinds whose developing colors are blue, black and red were prepared by mixing developer dispersion liquid, sensitizer dispersion liquid, lubricant dispersion liquid, recrystalization-inhibitor dispersion liquid, calcium-carbonate-dispersion liquid, 10%-PVA dispersion liquid, surfactant, and water with leuco-dye dispersion liquid of each color of blue, black, and red, as displayed below.

| | |
|---|---|
| Leuco dye dispersion liquid (30% of solid composition)<br>A leuco dye dispersion liquid was prepared by adding to water a dispersant of GOHSERAN L-3266 (manufactured by The Nippon Synthetic Chemical Industry Co., Ltd.) so as to obtain 5% concentration and further adding one of the following leuco dyes and then grinding the particles with a sand mill to obtain an average particle size of 0.8 μm. Using each of the leuco dyes of different colors, three dispersion leuco dye liquids of blue, black, and red were prepared.<br>Blue (CVL, manufactured by Yamamoto Chemicals Inc.)<br>Black (OBD-2, manufactured by Yamamoto Chemicals Inc.)<br>Red (Vermilton-DCF, manufactured by Hodogaya Chemical Co., Ltd.) | 50 parts |
| Developer dispersion liquid (40% of solid composition)<br>D-8 (developer), manufactured by Nippon Soda Co., Ltd.<br>F-647 (dispersion liquid using D-8), manufactured by Chukyo Yushi Co., Ltd. | 75 parts |
| Sensitizer dispersion liquid (30% of solid composition)<br>A sensitizer dispersion liquid was prepared such that, GOHSERAN L-3266 (manufactured by The Nippon Synthetic Chemical Industry Co., Ltd.) as a dispersant was added to water so as to obtain 5% concentration, and a sensitizer, indicated below, was added to it, and then the liquid was grinded using a sand mill so as to get an average particle size of 0.8 μm.<br>HS-3520, manufactured by Dainippon Ink & Chemicals Co., Ltd. | 100 parts |
| Lubricant dispersion liquid (30% of solid composition)<br>Zinc stearate: HIDRIN Z-7-30, manufactured by Chukyo Yushi Co., Ltd. | 32 parts |

-continued

| | |
|---|---|
| Recrystalization-inhibitor dispersion liquid (35% of solid composition)<br>DH43 (recrystalization-inhibitor), manufactured by Asahi Denka Co., Ltd.<br>HYDRIN F-165 (recrystalization-inhibitor dispersion liquid), manufactured by Chukyo Yushi Co., Ltd. | 20 parts |
| Calcium carbonate dispersion liquid (30% of solid component)<br>A calcium carbonate dispersion liquid was prepared such that, GOHSERAN L-3266 (manufactured by The Nippon Synthetic Chemical Industry Co., Ltd.) as a dispersant was added to water so as to obtain 5% concentration, and a calcium carbonate, indicated below, was added to it, and then the liquid was grinded using a sand mill so as to get an average particle size of 0.8 μm.<br>KARURAITO-KT, manufactured by Shiraishi Central Laboratories | 50 parts |
| 10%-PVA solution<br>PVA110, manufactured by Kralle Co., Ltd. | 53 parts |
| Surfactant (10% of solid composition)<br>ADEKACOL EC4500, manufactured by Asahi Denka Co., Ltd. | 33 parts |
| Water | 25 parts |

Each of the water-dispersion thermosensitive inks prepared in the above process 9d) was adjusted so that the viscosity falls in a range between 30 and 40 cps (measured with an E type viscometer) and the surface tension becomes 30 m N/m or lower (measured with a K12-Mk5 surface tension balance, manufactured by Kruss GmbH). Lowering the surface tension of the water-dispersion thermosensitive ink using a surfactant is particularly effective, when printing with an engraved plate, since the water-dispersion thermosensitive ink having a high surface tension makes it difficult to let the ink intrude into engraved parts in an engraved plate.

9e) Formation of Thermosensitive Coloring Layers

Each of the water-dispersion thermosensitive inks prepared in 9d) in the above was printed on ink receptive layer 3 formed in 9c) using a simplified photogravure printing machine (K Printing Proofer, available from Matsuo Sangyo Co., Ltd.), equipped with an etched plate having 150 lines in cell density and 40 μm in cell depth, so that a respective thermosensitive coloring layers were produced. In this thermosensitive recording medium 1, thermosensitive coloring layer 4*a* develops blue, 4*b* develops black, and 4*c* develops red.

Formation of Auxiliary Coloring Layer

9f) Preparation of Water-Dispersion Ink for Auxiliary Coloring Layer

The following compositions were mixed to prepare this water-dispersion ink.

| | |
|---|---|
| Developer dispersion liquid (40% of solid composition)<br>D-8 (developer), manufactured by Nippon Soda Co., Ltd.<br>F-647 (dispersion liquid using D-8), manufactured by Chukyo Yushi Co., Ltd. | 37.5 parts |
| Binder resin solution (30% of solid component)<br>BI-103 (brand name), manufactured by Harima Chemicals, Inc. | 2.5 parts |
| Water | 38.5 parts |
| Surfactant (10% of solid composition) | 8.7 parts |

ADEKACOL EC4500, manufactured by Asahi Denka Co., Ltd.

9g) Formation of Auxiliary Coloring Layer

Auxiliary coloring layer 5 was formed such that water-dispersion ink for the auxiliary coloring layer prepared in process 9f) was coated with a bar coater over thermosensitive coloring layers that were formed in process 9e) in an amount of the ink corresponding to a weight of 1.5 g/m$^2$ of the coating after dried. Then, a thermosensitive recording medium was produced such that a protective layer was formed over the auxiliary coloring layer made in the above by coating OCA-5, manufactured by Nippon Kayaku Co., Ltd., with a coater over the layer in an amount corresponding to a weight of 1 g/m$^2$ of the coating after dried.

Figure 12:
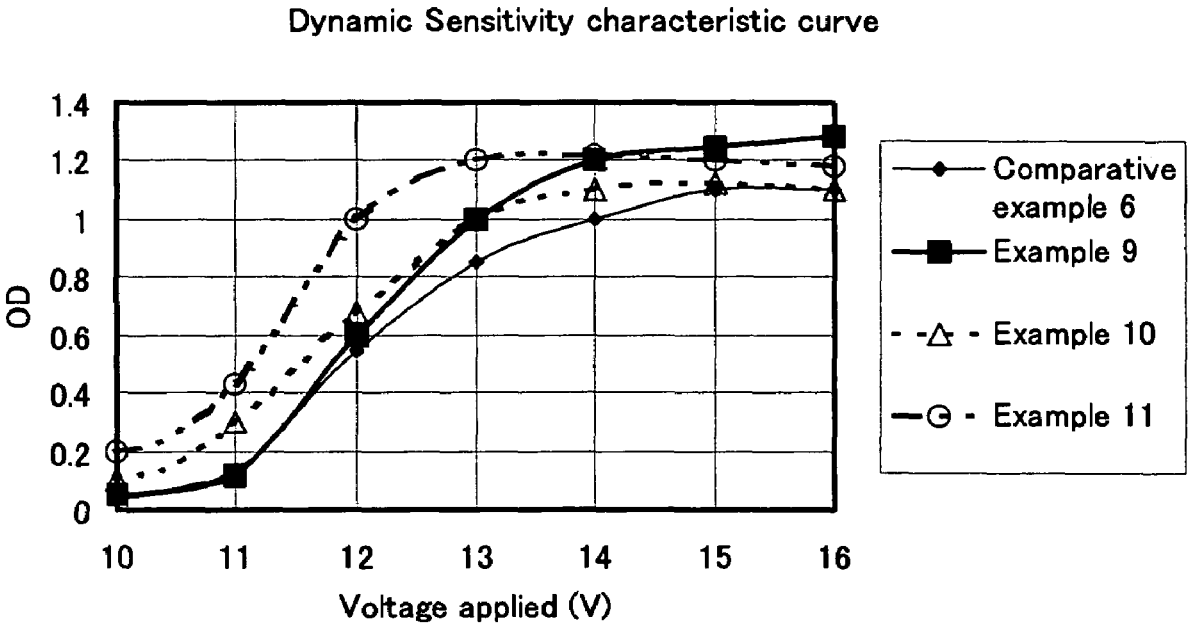
FIG. 12 is a graph indicating coloring characteristics of thermosensitive recording mediums in examples 9 through 11 and comparative example 6.

The thermosensitive recording medium produced in the above processes 9a) though 9g) was evaluated using a thermal printhead, type KBE-56-8MGK1 manufactured by Kyocera Corporation. Setting the recording condition at 5 msec/line for printing cycle, 70% for duty cycle, and applied voltage at between 10 and 16 volts (changing the voltage in unit of 1 volt), a coloring sensitivity and OD value (color density) of recorded images were measured. The measurements result is shown in FIG. 12.

Streaking on thermosensitive coloring layers 4*a*, 4*b*, and 4*c* during printing was unquestionable since the medium was provided with ink receptive layer 3. The examination further revealed that, as to the coloring sensitivity, almost no difference was observed between this example and comparative example 6, which will be described later; the color density improved due to a developer added to auxiliary coloring layer 5; and, void diminished. The evaluation was applied to the part of thermosensitive coloring layer 4*b* that develops black. Comparative example 6 (to be described later) differs from this example 9 wherein the former lacks auxiliary coloring layer 5, otherwise they are the same. Although the coloring sensitivity in this example showed more or less the same as that in comparative example 6, the saturation value in color density in this example has improved by a degree of 0.2 than that in comparative example 6. The reason for the improvement of the color density is considered that, because the auxiliary coloring layer 5 containing the developer was provided in the medium, much of the developer that was added to auxiliary coloring layer 5 exists on the surface (heat-applied side) of thermosensitive coloring layers 4 without penetrating deeply into ink receptive layer 3.

EXAMPLE 10

In example 9, a developer was added to the auxiliary coloring layer. In this example 10, a sensitizer, which contributes to improving thermal sensitivity of thermosensitive coloring layers 4, instead of the developer, was added to auxiliary coloring layer 5. Otherwise, the structural conditions in the medium remain the same as that in example 9. That is, ink receptive layer 3 as described in example 9 is formed on substrate 2, then thermosensitive coloring layers 4 were formed on the ink receptive layer 3 by printing each of water-dispersion thermosensitive inks as described in example 9 using a simplified photogravure printing machine (K Printing Proofer, available from Matsuo Sangyo Co., Ltd.), equipped with an etched plate having 175 lines in cell density and 34 μm in cell depth, and the following auxiliary coloring layer was formed over the thermosensitive coloring layers 4.

Formation of Auxiliary Coloring Layer

10f) Preparation of Water-Dispersion Ink for Auxiliary Coloring Layer

A water-dispersion ink was prepared by mixing the following compositions.

| | |
|---|---|
| Sensitizer dispersion liquid (30% of solid composition) HS-3520, manufactured by Dainippon Ink & Chemicals Co., Ltd. This sensitizer dispersion liquid was prepared such that, GOHSERAN L-3266 (manufactured by The Nippon Synthetic Chemical Industry Co., Ltd.) as a dispersant was added to water so as to obtain 5% concentration, and a sensitizer, indicated below, was added to, and dipersed in the liquid using a sand mill so as to get an average particle size of 0.8 μm. | 50 parts |
| Binder resin solution (30% of solid component) BI-103 (brand name), manufactured by Harima Chemicals, Inc. | 2.5 parts |
| Water | 26.25 parts |
| Surfactant (10% of solid composition) ADEKACOL EC4500, manufactured by Asahi Denka Co., Ltd. | 8.7 parts |

10g) Formation of Auxiliary Coloring Layer

Auxiliary coloring layer 5 was formed such that, first, the water-dispersion ink prepared in process 10f) was coated with a bar coater over thermosensitive coloring layers 4 formed in process 9e) in an amount of the ink corresponding to a weight of 1.5 g/m$^2$ of the coating after dried. Then, a protective layer was formed over the auxiliary coloring layer made in the above by coating over the layer OCA-5, manufactured by Nippon Kayaku Co., Ltd., by a coater in an amount corresponding to a weight of 1 g/m$^2$ of the coating after dried, so that a thermosensitive recording medium 1 was obtained.

Using the thermosensitive recording medium 1 produced in this example 10, coloring sensitivity and color density of the thermosensitive coloring layer 4*b* (black) were measured as in examples 9. The measurements result is shown in FIG. 12. As seen in FIG. 12, comparing to comparative example 6, there was no change on the saturation value in color density. It can be seen that the coloring sensitivity has improved from the fact that a color density of the same degree as in example 6 was obtained even if the voltage applied to the thermal printhead was lowered by 1 volt. This is due to the addition of a sensitizer to the auxiliary coloring layer 5, more specifically because the sensitizer contained in the auxiliary coloring layer 5 was present on a surface of thermosensitive coloring layer 4 without penetrating deeply into ink receptive layer 3.

EXAMPLE 11

In example 9, a developer was added to auxiliary coloring layer 5, while in example 10 a sensitizer was added to auxiliary coloring layer 5. In this example 11, both a developer and sensitizer are added to auxiliary coloring layer 5, and the structure remains otherwise the same as those of examples 9 and 10. That is, ink receptive layer 3 as described in example 9 is formed on substrate 2, then thermosensitive coloring layers 4 were formed on this ink receptive layer 3 by printing each of water-dispersion thermosensitive inks as described in example 9 using a simplified photogravure printing machine (K Printing Proofer, available from Matsuo Sangyo Co., Ltd.), equipped with an etched plate having 175 lines in cell density and 34 μm in cell depth, and the following auxiliary coloring layer 5 was formed over this thermosensitive coloring layers 4.

Formation of Auxiliary Coloring Layer

11f) Preparation of Water-Dispersion Ink for Auxiliary Coloring Layer

A water-dispersion ink was prepared by mixing the following compositions.

| | |
|---|---|
| Developer dispersion liquid (40% of solid composition) D-8 (developer), manufactured by Nippon Soda Co., Ltd. F-647 (dispersion liquid using D-8), manufactured by Chukyo Yushi Co., Ltd. | 37.5 parts |
| Sensitizer dispersion liquid (30% of solid composition) HS-3520, manufactured by Dainippon Ink & Chemicals Co., Ltd. This sensitizer dispersion liquid was prepared such that, GOHSERAN L-3266 (manufactured by The Nippon Synthetic Chemical Industry Co., Ltd.) as a dispersant was added to water so as to obtain 5% concentration, and the sensitizer was added to, and dipersed in the liquid using a sand mill so as to get an average particle size of 0.8 μm. | 50 parts |
| Binder resin solution (30% of solid component) BI-103 (brand name), manufactured by Harima Chemicals, Inc. | 5 parts |
| Water | 65 parts |
| Surfactant (10% of solid composition) ADEKACOL EC4500, manufactured by Asahi Denka Co., Ltd. | 8.7 parts |

11g) Formation of Auxiliary Coloring Layer

Auxiliary coloring layer 5 was formed such that, first, the water-dispersion ink prepared in process 11f) was coated with a bar coater over thermosensitive coloring layers 4 formed in process 9e) in an amount of the ink corresponding to a weight of 1.5 g/m$^2$ of the coating after dried. Then, a protective layer was formed over the auxiliary coloring layer made in the above by coating over the layer OCA-5, manufactured by Nippon Kayaku Co., Ltd., by a coater in an amount corresponding to a weight of 1 g/m$^2$ of the coating after dried, so that a thermosensitive recording medium 1 was obtained.

Using the thermosensitive recording medium 1 produced in this example 11, coloring sensitivity and color density of the thermosensitive coloring layer 4*b* (black) were measured as in examples 9 and 10. The measurements result is shown in FIG. 12. Comparing to comparative example 6, the saturation value in color density improved by some 0.1 to 0.15 by virtue of the developer and the voltage applied to a thermal printhead could be lowered by some 2 volts by effect of the sensitizer. The improvements in the color density and coloring sensitivity are because the developer and sensitizer added to the auxiliary coloring layer 5 were present on a surface of thermosensitive coloring layer 4 without penetrating deeply into ink receptive layer 3.

COMPARATIVE EXAMPLE 6

In this comparative example, auxiliary coloring layer 5 was not provided in thermosensitive recording medium 1 in example 9 (or examples 10, 11). Using the thermosensitive recording medium produced in this comparative example 6, coloring sensitivity and color density of thermosensitive coloring layer 4*b* (black) were measured as in examples 9 through 11. The measurements result is shown in FIG. 12. In this comparative example 6, since auxiliary coloring layer 5 was not provided in the medium, the saturation voltage applied to a thermal printhead was between 14 and 15 volts, and the saturation value in color density was 1.08. It can be seen that the thermosensitive recording medium in this comparative example 6 exhibited low in either saturation value in color density or coloring sensitivity, comparing to those in examples 9 through 11. The reason for this is considered that only part of the water-dispersion thermosensitive ink that resides on a surface of the ink receptive layer 3 in a total amount of the ink penetrated into ink receptive layer 3 has contributed to the color development.

EXAMPLE 12

Thermosensitive recording medium 1 used in this example 12 is the same as that of example 9, except for a structure of ink receptive layer 3.

Formation of Ink Receptive Layer

12a) Pigment Dispersion Liquid

A pigment dispersion liquid of hydrophilic silica was prepared by dispersing the following compositions using a homogenizer.

| | |
|---|---|
| Calcined kaolin<br>KAOCAL (brand name), available from Shiraishi Kogyo Kaisha Ltd. | 100 parts |
| Hydrophilic silica<br>Nipsil E-220A (brand name), manufactured by Tosoh Silica Corp. | 11 parts |
| Sodium polyacrylate (dispersant) | 1 part |
| Water | 318 parts |

12b) Coating Liquid

This coating liquid for ink receptive layer 3 was prepared by adding dispersing, and mixing the following components to/in the pigment dispersion liquid prepared in the above process 12a) using a homogenizer.

| | |
|---|---|
| Styrene-butadiene copolymer latex<br>48%-SBR dispersion liquid, manufactured by JSR | 56 parts |
| Phosphate ester starch<br>MS-4600 (20% aqueous solution), manufactured by Nihon Shokuhin Kako Co., Ltd. | 37 parts |
| Developer dispersion liquid (40% of solid composition)<br>D-8 (developer), manufactured by Nippon Soda Co., Ltd.<br>F-647 (dispersion liquid using D-8), manufactured by Chukyo Yushi Co., Ltd. | 97 parts |
| Lubricant dispersion liquid (30% of solid composition)<br>Zinc stearate: HIDRIIN Z-7-30 (brand name), manufactured by Chukyo Yushi Co., Ltd. | 41 parts |
| Recrystalization-inhibitor dispersion liquid (35% of solid composition)<br>DH43 (recrystalization-inhibitor), manufactured by Asahi Denka Co., Ltd.<br>HYDRIN F-165 (recrystalization-inhibitor dispersion liquid), manufactured by Chukyo Yushi Co., Ltd. | 26 parts |

12c) Formation of Ink Receptive Layer

Ink receptive layer 3 was formed on substrate 2 such that the coating liquid prepared in process 12b) above was coated with a bar coater on substrate 2 (quality paper) having weight of 65 in an amount of the ink corresponding to a weight of 8 g/m$^2$ of the coating after dried. The structure of the thermosensitive recording medium 1 in this example 12, otherwise, is the same as in example 9. Thermosensitive recording medium 1 was produced such that; first, thermosensitive coloring layers 4 were formed such that the water-dispersion thermosensitive ink in example 9 was printed on ink receptive layer 3 using a simplified photogravure printing machine (K Printing Proofer, available from Matsuo Sangyo Co., Ltd.), equipped with an etched plate having 175 lines in cell density and 34 μm in cell depth; then, the same auxiliary coloring layer 5 (one containing a developer) as in example 9 was formed on the thermosensitive coloring layers just formed in the above; and, a protective layer was formed over the auxiliary coloring layer formed in the above by coating OCA-5, manufactured by Nippon Kayaku Co., Ltd., using a coater over the layer in an amount of the ink corresponding to a weight of 1 g/m$^2$ of the coating after dried.

Figure 13:
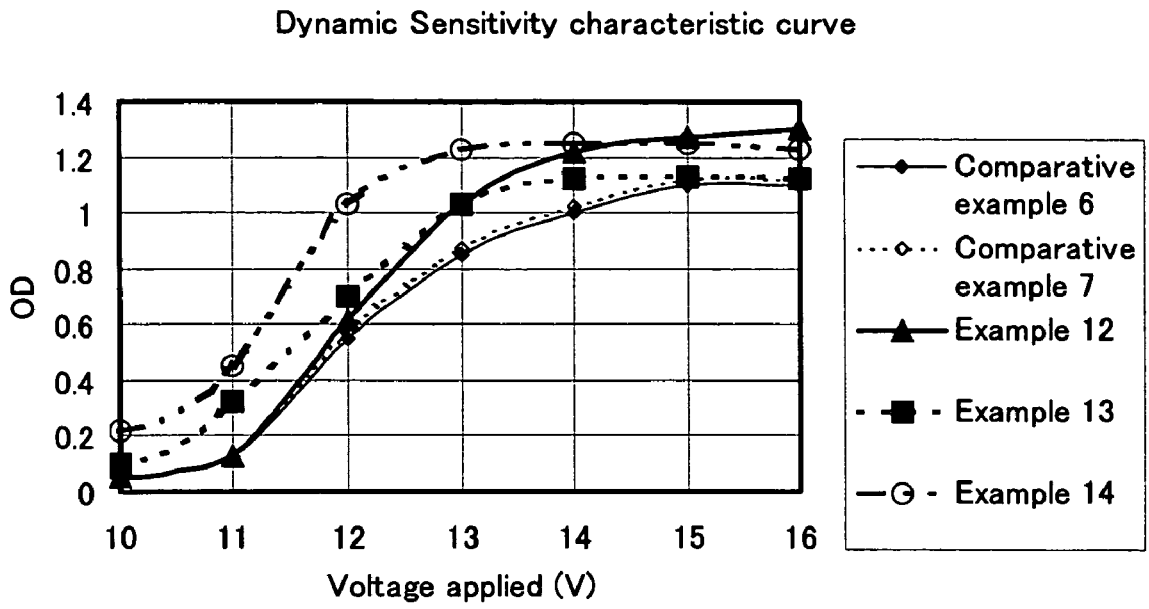
FIG. 13 is a graph indicating coloring characteristics of thermosensitive recording mediums in examples 12 through 14 and comparative examples 6 and 7.

Using the thermosensitive recording medium 1 produced in this example 12, coloring sensitivity and color density of thermosensitive coloring layer 4*b* were measured as done in examples 9 through 11. The measurements result is shown in FIG. 13. The medium used in comparative example 7 is the same as in this example 12 except that one in comparative example 7 lacks an auxiliary coloring layer in it. The medium in this example 12, comparing to one in comparative example 7, the saturation value in color density improved by some 0.2, as in example 9, while the coloring sensitivity (a voltage at which a medium begins to develop color) did not change so much. The reason for this is considered to be same as in example 9. The color density was increased comparing to that in example 9 because the ink receptive layer 3 also contained the developer.

EXAMPLE 13

The medium in this example used the ink receptive layer 3 described in example 12. Otherwise, the structure remained the same as in example 10. That is, in this example, a thermosensitive recording medium 1 was produced such that, first, thermosensitive coloring layers 4 were formed such that the water-dispersion thermosensitive inks used in examples 9 through 11 were printed on the ink receptive layer 3 (one containing a developer) as described in example 12 using a simplified photogravure printing machine (K Printing Proofer, available from Matsuo Sangyo Co., Ltd.), equipped with an etched plate having 175 lines in cell density and 34 μm in cell depth; next, the auxiliary coloring layer 5 (one containing a sensitizer) described in example 10 was formed over the above-mentioned thermosensitive coloring layers; last, a protective layer was formed over the above-mentioned auxiliary coloring layer by coating OCA-5, manufactured by Nippon Kayaku Co., Ltd., with a coater over the layer in an amount corresponding to a weight of 1 g/m$^2$ of the coating after dried.

Using the thermosensitive recording medium 1 produced in this example 13, coloring sensitivity and color density of thermosensitive coloring layer 4*b* were measured as in examples 9 through 12. The measurements result is shown in FIG. 13. The medium in this example, comparing to one in comparative example 7, the coloring sensitivity improved to a degree that the same degree of coloring density was obtained even if the voltage applied to the thermal printhead was lowered by some 1 to 2 volts, as in example 10, while the saturation value in color density did not change so much. The reason for this is considered to be same as in example 10.

EXAMPLE 14

The medium in this example used the ink receptive layer 3 described in example 12. Otherwise, the structure remained the same as in example 11. That is, in this example 14, a thermosensitive recording medium 1 was produced such that; first, thermosensitive coloring layers 4 were formed such that the water-dispersion thermosensitive inks used in examples 9 through 11 were printed on the ink receptive layer 3 (one containing a developer) as described in example 12 using a simplified photogravure printing machine (K Printing Proofer, available from Matsuo Sangyo Co., Ltd.), equipped with an etched plate having 175 lines in cell density and 34 μm in cell depth; next, the auxiliary coloring layer 5 (one containing a developer and sensitizer) described in example 11 was formed over the above-mentioned thermosensitive coloring layers; last, a protective layer was formed over the above-mentioned auxiliary coloring layer by coating OCA-5, manufactured by Nippon Kayaku Co., Ltd., with a coater over the layer in an amount corresponding to a weight of 1 g/m$^2$ of the coating after dried.

Using the thermosensitive recording medium 1 produced in this example 14, coloring sensitivity and color density of thermosensitive coloring layer 4*b* were measured as in examples 9 through 13. The measurements result is shown in FIG. 13. It can be seen that the medium in this example has improved in respect to both the coloring sensitivity and color density, comparing to one in comparative example 7. The reason for this is considered to be same as in example 11.

COMPARATIVE EXAMPLE 7

In this comparative example 7, auxiliary coloring layer 5 was not provided in thermosensitive recording medium 1 of example 12 (or examples 13 and 14). Using the thermosensitive recording medium 1 produced in this comparative example 7, coloring sensitivity and color density of thermosensitive coloring layer 4*b* (black) were measured as in examples 12 through 14. The measurements, together with those of the aforementioned comparative example 6, are shown in FIG. 13. It can be seen that only degrees of the sensitivity and color density at nearly the same as those in comparative example 6 were gained even if a developer was added to the ink receptive layer 3. The reason for this is presumed that the developer residing deeply inside the ink receptive layer 3 has not much contributed to the color development.

EXAMPLE 15

Thermosensitive recording medium 1 in this example is the same as that in example 12 except for a structure of thermosensitive coloring layers 4. In example 12, a developer was added to ink receptive layer 3.

Formation of Thermosensitive Coloring Layer

15d) Water-Dispersion Ink

Water-dispersion inks of three kinds whose developing colors are blue, black and red were prepared by mixing a BI-103 resin solution and a surfactant in the respective leuco-dye dispersion liquids of blue, black, and red, as displayed below.

| | |
|---|---|
| Leuco dye dispersion liquid (30% of solid composition)<br>A leuco dye dispersion liquid was prepared by adding to water a dispersant of GOHSERAN L-3266 (manufactured by The Nippon Synthetic Chemical Industry Co., Ltd.) so as to obtain 5% concentration and further adding to and dispersing in the liquid one of the following leuco dyes and then grinding the particles with a sand mill to obtain an average particle size of 0.8 μm.<br>Blue (CVL, manufactured by Yamamoto Chemicals Inc.)<br>Black (OBD-2, manufactured by Yamamoto Chemicals Inc.)<br>Red (Vermilton-DCF, manufactured by Hodogaya Chemical Co., Ltd.) | 50 parts |

-continued

| | |
|---|---|
| BI-103 (30% of solid composition), manufactured by Harima Chemicals, Inc. | 3 parts |
| Surfactant (10% of solid composition)<br>ADEKACOL EC4500, manufactured by Asahi Denka Co., Ltd. | 1 part |

15e) Formation of Thermosensitive Coloring Layers

In this example 15, a thermosensitive recording medium 1 was produced such that; first, thermosensitive coloring layers 4 were formed such that each of the water-dispersion inks prepared in the above is printed on ink receptive layer 3 described in example 12 using a simplified photogravure printing machine (K Printing Proofer, available from Matsuo Sangyo Co., Ltd.), equipped with an etched plate having 175 lines in cell density and 34 μm in cell depth; next, over the thermosensitive coloring layers 4 in the above, the same auxiliary coloring layer 5 as in example 12 was formed; then, a protective layer was formed over the auxiliary coloring layer 5 by coating OCA-5, manufactured by Nippon Kayaku Co., Ltd., with a coater over the layer in an amount corresponding to a weight of 1 g/m$^2$ of the coating after dried.

Figure 14:
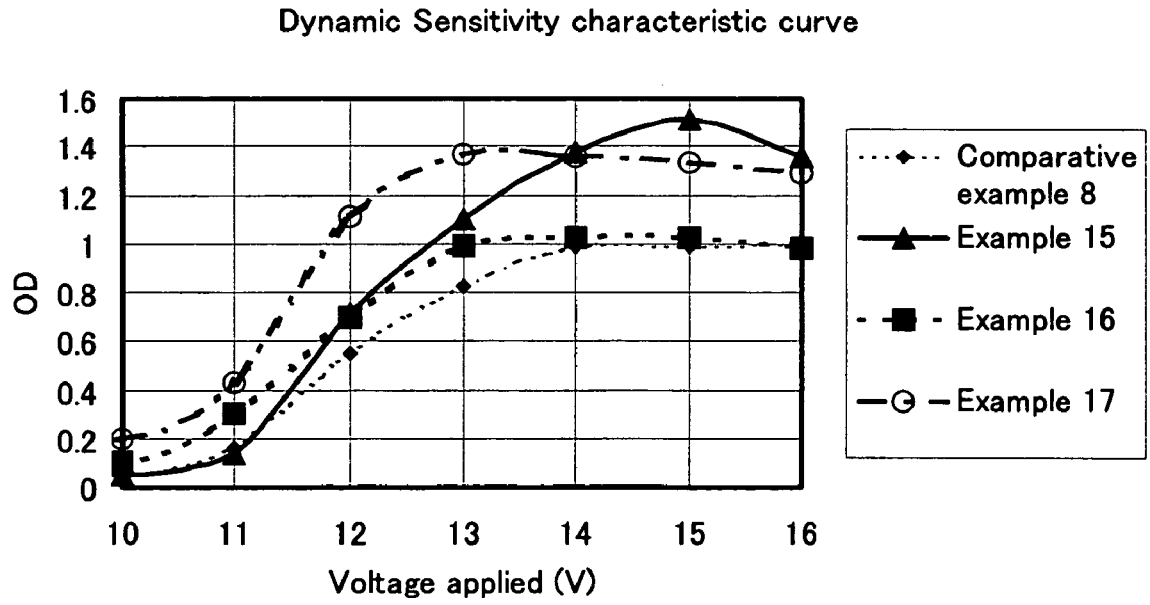
FIG. 14 is a graph showing coloring characteristics of thermosensitive recording mediums in examples 15 though 17 and comparative example 8.

Using the thermosensitive recording medium 1 produced in this example 15, coloring sensitivity and color density of thermosensitive coloring layer 4*b* were measured as in examples 9 through 14. The measurements result is shown in FIG. 14. The medium in this example, comparing to one in comparative example 8 that will be described later, the saturation value in color density improved by some 0.2 as in example 9 and 12, while a development starting voltage did not change so much. The reason for this is considered to be same as in examples 9 and 12.

EXAMPLE 16

Thermosensitive recording medium 1 in this example is the same as example 13 except for a structure of thermosensitive coloring layers 4, while the thermosensitive coloring layers 4 in this example is the same as in example 15.

In this example 16, a thermosensitive recording medium 1 was produced such that; first, thermosensitive coloring layers 4 were formed such that the water-dispersion inks prepared described in example 15 is printed on ink receptive layer 3 described in example 13 using a simplified photogravure printing machine (K Printing Proofer, available from Matsuo Sangyo Co., Ltd.), equipped with an etched plate having 175 lines in cell density and 34 μm in cell depth; next, over the thermosensitive coloring layers 4, auxiliary coloring layer 5, the same as in example 13 was formed; then, a protective layer was formed over the auxiliary coloring layer 5 by coating OCA-5, manufactured by Nippon Kayaku Co., Ltd., with a coater over the layer in an amount corresponding to a weight of 1 g/m$^2$ of the coating after dried.

Using the thermosensitive recording medium 1 produced in this example 16, coloring sensitivity and color density of thermosensitive coloring layer 4*b* were measured as in examples 9 through 15. The measurements result is shown in FIG. 14. The medium in this example, comparing to one in comparative example 8, the coloring sensitivity improved to a degree that the same degree of coloring density was obtained even if the voltage applied to the thermal printhead was lowered by some 0.5 to 1 volt, as in example 10. The reason for this is considered to be same as in examples 10 and 13.

EXAMPLE 17

Thermosensitive recording medium 1 in this example is the same as example 14 except for a structure of thermosensitive coloring layers 4, while the thermosensitive coloring layers 4 in this example is the same as in example 15.

In this example 17, a thermosensitive recording medium 1 was produced such that; first, thermosensitive coloring layers 4 were formed such that the water-dispersion thermosensitive ink prepared described in example 15 was printed on the ink receptive layer 3 described in example 14 using a simplified photogravure printing machine (K Printing Proofer, available from Matsuo Sangyo Co., Ltd.), equipped with an etched plate having 175 lines in cell density and 34 μm in cell depth; next, the same auxiliary coloring layer 5 as in example 14 was formed over the thermosensitive coloring layers 4 in the above; then, a protective layer was formed over the auxiliary coloring layer 5 in the above by coating OCA-5, manufactured by Nippon Kayaku Co., Ltd., with a coater over the layer in an amount corresponding to a weight of 1 g/m$^2$ of the coating after dried.

Using the thermosensitive recording medium 1 produced in this example 17, coloring sensitivity and color density of thermosensitive coloring layer 4*b* were measured as in examples 9 through 16. The measurements result is shown in FIG. 14. The medium in this example, comparing to one in comparative example 8, the coloring sensitivity improved to a degree that the same degree of coloring density was obtained even if the voltage applied to the thermal printhead was lowered by some 1.5 volts, and the saturation value in color density also improved by some 0.3. The reason for this is considered to be same as in examples 11 and 14.

COMPARATIVE EXAMPLE 8

In this comparative example, auxiliary coloring layer 5 was not provided in the thermosensitive recording medium 1 in example 15 (or examples 16, 17). Using the thermosensitive recording medium produced in this comparative example 8, coloring sensitivity and color density of thermosensitive coloring layer 4*b* (black) were measured as in examples 15 through 17. The measurements result is shown in FIG. 14. It can be seen that the thermosensitive recording medium in this comparative example 8 exhibited inferior than those in examples 15 through 17 in both coloring sensitivity and color density.

Although a developer was added in the ink receptive layer 3 in examples 15 through 17, the addition of the developer may be omitted as to those examples. Even when the developer was omitted in examples 15 and 17, the mediums showed superior in coloring characteristics (coloring sensitivity and color density) than that in comparative example 8 by virtue of the developer added in the auxiliary coloring layer 5. This indicates that addition of the developer in the auxiliary coloring layer works more effectively than addition of the one in the ink receptive layer 3.

Also, although, in each of the examples described above, a bar coater was used for forming auxiliary coloring layer 5, a printing process (for example, gravure printing process) may be used instead because the amount of coating was a little.

<Evaluation>

Measurements of coloring sensitivity and coloring sensitivity for the mediums produced in examples 9 through 17, and comparative examples 6 through 8 were made under conditions below:

Printer Used and Recording Condition:

| | |
|---|---|
| Thermal printhead: | type KBE-56-8MGK1 (200 dpi), manufactured by Kyocera Corp. |
| Resistance: | 1213 ohms |
| Recording period: | 5 msec/line |
| Energized time: | 3.5 msec (at printing duty of 70%) |
| Voltages applied: | 10 to 16 volts (0.288 to 0.738 mJ/dot) |

Note: In order to show distinct effect of auxiliary coloring layer 5, the impressions of the printhead to the media throughout the evaluation tests was set weaker than a force in normal recording. For this reason, the tests were made raising the applied energy by some degree.

Test Method and Result:

Printed samples were subjected to measurement of O.D. value (color density) on the recording samples by Macbeth reflection densitometer type RD-19. Then, the measurements were plotted onto graphs in FIGS. 12 through 14, and studied.

Figure 15:
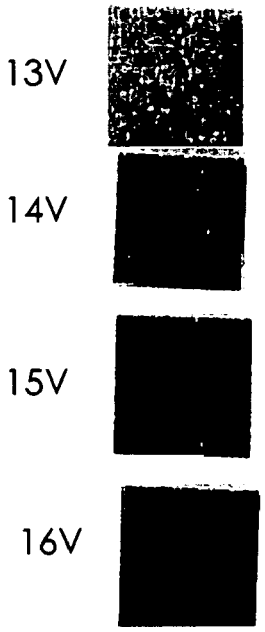
FIG. 15 is a photograph showing examples of recording performed in example 3 and comparative example 1.
Figure 15:
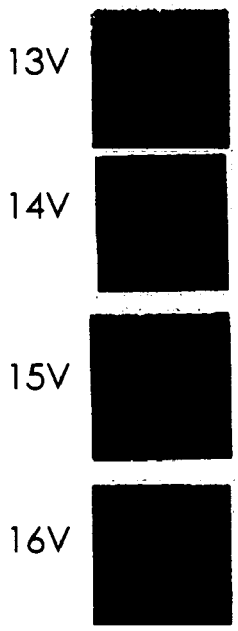

Also, actual recordings on the media, as shown in FIG. 15, were visually examined. FIG. 15 displays recordings in example 11 and comparative example 6, which were carried out at applied voltages in a range of between 13 and 16 volts.

It can be seen in FIG. 15 that, under the same voltage applied, the color density in example 11 was showed greater than the other. For example, at 15 volts applied in both examples, some voids appeared in the sample of comparative example 6, whereas such voids could hardly be recognized in example 11 due to the auxiliary coloring layer 5 provided. Thus, it can be understood that, even under the same printing condition, the problem of void can be diminished by improving coloring sensitivity and color density.

Numerous modifications and variations of the present invention are possible in light of the above teachings. It is therefore to be understood that, within the scope of the appended claims, the present invention can be practiced in a manner other than as specifically described therein.

What is claimed is:

1. A thermosensitive recording medium for recording an image thereon by a thermal recording apparatus, comprising:

a substrate;

a porous ink receptive layer formed on a surface of said substrate, said porous ink receptive layer containing a pigment as its main component and a binder resin, said pigment in said ink receptive layer is a porous pigment formed by a flocculated mass of primary particles thereof; and a thermosensitive coloring layer formed integrally with said ink receptive layer by impregnating said ink receptive layer with a water-dispersion thermosensitive ink that has been prepared by dispersing in water dispersion components including at least an electron-accepting compound and an electron-donating compound, the thermosensitive coloring layer developing a color, wherein an average particle size of said pigment is greater than an average particle size of particles within said dispersion components in said water-dispersion thermosensitive ink.

2. A thermosensitive recording medium according to claim 1, wherein the pigment in said ink receptive layer is a hydrophilic pigment.

3. A thermosensitive recording medium according to claim 2, wherein the hydrophilic pigment is a porous pigment formed by a flocculated mass of primary particles thereof.

4. A thermosensitive recording medium according to claim 3, wherein the porous pigment is hydrophilic silica formed by a flocculated mass of primary particles thereof.

5. A thermosensitive recording medium according to claim 1, further comprising an auxiliary coloring layer formed over said thermosensitive coloring layer, the auxiliary coloring layer containing at least an electron-accepting compound.

6. A thermosensitive recording medium according to claim 1, further comprising an auxiliary coloring layer formed over said thermosensitive coloring layer, the auxiliary coloring layer containing at least a sensitizer that contributes to improving thermal sensitivity of said thermosensitive coloring layer.

7. A thermosensitive recording medium according to claim 1, further comprising an auxiliary coloring layer formed over said thermosensitive coloring layer, the auxiliary coloring layer containing at least an electron-accepting compound and a sensitizer that contributes to improving thermal sensitivity of said thermosensitive coloring layer.

8. A method of manufacturing a thermosensitive recording medium for recording an image thereon by a thermal recording apparatus, the method comprising:

forming a porous ink receptive layer on a substrate, said porous ink receptive layer containing a pigment as its main component and a binder resin;

forming an auxiliary coloring layer over said thermosensitive coloring layer, the auxiliary coloring layer containing at least one of an electron-accepting compound and a sensitizer that contributes to improving thermal sensitivity of said thermosensitive coloring layer; and forming a thermosensitive coloring layers integrally with said ink receptive layer by impregnating said ink receptive layer by means of a printing process using a printing plate with a water-dispersion thermosensitive ink that has been prepared by dispersing in water dispersion components including at least an electron-accepting compound and an electron-donating compound, wherein an average particle size of said pigment is greater than an average particle size of particles within said dispersion components in said water-dispersion thermosensitive ink.

9. A thermosensitive recording medium for recording an image thereon by a thermal recording apparatus, comprising:

a substrate;

a porous ink receptive layer formed on a surface of said substrate, said ink receptive layer containing a pigment as its main component, a binder resin, and an electron-accepting compound, said pigment in said ink receptive layer is a porous pigment formed by a flocculated mass of primary particles thereof; and a thermosensitive coloring layer formed integrally with said ink receptive layer by impregnating said ink receptive layer with a water-dispersion ink that has been prepared by dispersing in water a dispersion component including at least an electron-donating compound, the thermosensitive coloring layer developing a color, wherein an average particle size of said pigment is greater than an average particle size of particles within said dispersion components in said water-dispersion ink.

10. A thermosensitive recording medium according to claim 9, wherein the pigment in said ink receptive layer is a hydrophilic pigment.

11. A thermosensitive recording medium according to claim 10, wherein the hydrophilic pigment is a porous pigment formed by a flocculated mass of primary particles thereof.

12. A thermosensitive recording medium according to claim 11, wherein the porous pigment is hydrophilic silica formed by a flocculated mass of primary particles thereof.

13. A thermosensitive recording medium according to claim 9, further comprising an auxiliary coloring layer formed over said thermosensitive coloring layer, the auxiliary coloring layer containing at least an electron-accepting compound.

14. A thermosensitive recording medium according to claim 9, further comprising an auxiliary coloring layer formed over said thermosensitive coloring layer, the auxiliary coloring layer containing at least a sensitizer that contributes to improving thermal sensitivity of said thermosensitive coloring layer.

15. A thermosensitive recording medium according to claim 9, further comprising an auxiliary coloring layer formed over said thermosensitive coloring layer, the auxiliary coloring layer containing at least an electron-accepting compound and a sensitizer that contributes to improving thermal sensitivity of said thermosensitive coloring layer.

16. A method of manufacturing a thermosensitive recording medium for recording an image thereon by a thermal recording apparatus, the method comprising:

forming a porous ink receptive layer on a substrate, said porous ink receptive layer containing a pigment as its main component, a binder resin, and an electron-accepting compound;

forming an auxiliary coloring layer over the thermosensitive coloring layer, the auxiliary coloring layer containing at least one of an electron-accepting compound and a sensitizer that contributes to improving thermal sensitivity of the thermosensitive coloring layer; and forming a thermosensitive coloring layer integrally with said ink receptive layer by impregnating said ink receptive layer by means of a printing process using a printing plate with a water-dispersion ink that has been prepared by dispersing in water a dispersion component including at least an electron-donating compound, wherein an average particle size of said pigment is greater than an average particle size of particles within said dispersion component in said water-dispersion ink.

17. A thermosensitive recording medium for recording an image thereon by a thermal recording apparatus, comprising:

a substrate;

a porous ink receptive layer formed on a surface of said substrate containing a pigment as its main component, a binder resin, and an electron-accepting compound, said pigment in said ink receptive layer is a porous pigment formed by a flocculated mass of primary particles thereof; and a thermosensitive coloring layer formed integrally with said ink receptive layer by impregnating said ink receptive layer with a water-dispersion thermosensitive ink that has been prepared by dispersing in water dispersion components including at least an electron-accepting compound and an electron-donating compound, the thermosensitive coloring layer developing a color, wherein an average particle size of said pigment is greater than an average particle size of particles within said dispersion components in said water-dispersion thermosensitive ink.

18. A thermosensitive recording medium according to claim 17, wherein said pigment in said ink receptive layer is a hydrophilic pigment.

19. A thermosensitive recording medium according to claim 18, wherein the hydrophilic pigment is a porous pigment formed by a flocculated mass of primary particles thereof.

20. A thermosensitive recording medium according to claim 19, wherein the porous pigment is a porous pigment formed by a flocculated mass of primary particles thereof.

21. A thermosensitive recording medium according to claim 17, further comprising an auxiliary coloring layer formed over said thermosensitive coloring layer, the auxiliary coloring layer containing at least an electron-accepting compound.

22. A thermosensitive recording medium according to claim 17, further comprising an auxiliary coloring layer formed over said thermosensitive coloring layer, the auxiliary coloring layer containing at least a sensitizer that contributes to improving thermal sensitivity of said thermosensitive coloring layer.

23. A thermosensitive recording medium according to claim 17, further comprising an auxiliary coloring layer formed over said thermosensitive coloring layer, the auxiliary coloring layer containing at least an electron-accepting compound and a sensitizer that contributes to improving thermal sensitivity of said thermosensitive coloring layer.

24. A method of manufacturing a thermosensitive recording medium for recording an image thereon by a thermal recording apparatus, the method comprising:

forming a porous ink receptive layer on a substrate, said porous ink receptive layer containing a pigment as its main component, a binder resin, and an electron-accepting compound;

forming an auxiliary coloring layer over the thermosensitive coloring layer, the auxiliary coloring layer containing at least one of an electron-accepting compound and a sensitizer that contributes to improving thermal sensitivity of the thermosensitive coloring layer; and forming a thermosensitive coloring layer integrally with said ink receptive layer by impregnating said ink receptive layer by means of a printing process using a printing plate with a water-dispersion thermosensitive ink that has been prepared by dispersing in water dispersion components including at least an electron-accepting compound and an electron-donating compound, wherein an average particle size of said pigment is greater than an average particle size of particles within said dispersion components in said water-dispersion thermosensitive ink.

25. A thermosensitive recording medium for recording an image thereon by a thermal recording apparatus, comprising:

a substrate;

an ink receptive layer containing a pigment and binder resin formed on a surface of said substrate;

a thermosensitive coloring layer formed integrally with said ink receptive layer by impregnating said ink receptive layer with a water-dispersion ink that has been prepared by dispersing in water a dispersion component including at least an electron-donating compound; and an auxiliary coloring layer provided over said thermosensitive coloring layer, the auxiliary coloring layer containing at least an electron-accepting compound, the thermosensitive coloring layer developing a color.

26. A thermosensitive recording medium according to claim 25, wherein said water-dispersion ink contains a sensitizer.

27. A thermosensitive recording medium according to claim 25, wherein the auxiliary coloring layer contains a sensitizer that contributes to improving thermal sensitivity of said thermosensitive coloring layer.

28. A thermosensitive recording medium according to claim 25, wherein the ink receptive layer integrally includes a second thermosensitive coloring layer which develops one color different from the first thermosensitive coloring layer.

29. A method of manufacturing a thermosensitive recording medium for recording an image thereon by a thermal recording apparatus, the method comprising:

forming an ink receptive layer containing a pigment and a binder resin on a substrate;

forming a thermosensitive coloring layer integrally with said ink receptive layer by impregnating said ink receptive layer by means of a printing process using a printing plate with a water-dispersion ink that has been prepared by dispersing in water a dispersion component including at least an electron-donating compound; and forming an auxiliary coloring layer containing at least an electron-accepting compound over the thermosensitive coloring layer.

* * * * *